US009188116B2

(12) United States Patent
Kellar et al.

(10) Patent No.: US 9,188,116 B2
(45) **Date of Patent: *Nov. 17, 2015**

(54) HIGH PRESSURE PUMP

(71) Applicants: Franz W. Kellar, Gastonia, NC (US); Harold Lloyd Crowder, Jr., Concord, NC (US)

(72) Inventors: Franz W. Kellar, Gastonia, NC (US); Harold Lloyd Crowder, Jr., Concord, NC (US)

(73) Assignee: Kinemax Systems, LLC, Gastonia, NC (US)

( * ) Notice: Subject to any disclaimer, the term of this patent is extended or adjusted under 35 U.S.C. 154(b) by 17 days.

This patent is subject to a terminal disclaimer.

(21) Appl. No.: 13/621,415

(22) Filed: Sep. 17, 2012

(65) Prior Publication Data

US 2013/0017108 A1 Jan. 17, 2013

Related U.S. Application Data

(63) Continuation of application No. 12/606,516, filed on Oct. 27, 2009, now Pat. No. 8,267,672, which is a continuation-in-part of application No. 11/059,856, filed on Feb. 17, 2005, now Pat. No. 7,661,935.

(51) Int. Cl.

| | |
|---|---|
| ***F04B 17/03*** | (2006.01) |
| ***F04B 37/12*** | (2006.01) |
| ***B26F 3/00*** | (2006.01) |

(Continued)

(52) U.S. Cl.

CPC ..... *F04B 37/12* (2013.01); *B26F 3/004* (2013.01); *F04B 1/0408* (2013.01); *F04B 1/0413* (2013.01); *F04B 1/0421* (2013.01); *F04B 1/113* (2013.01); *F04B 9/042* (2013.01); *F04B 17/03* (2013.01); *F04B 53/16* (2013.01); *F04B 53/166* (2013.01)

(58) Field of Classification Search

CPC ..... B26F 3/004; F04B 1/10; F04B 1/113; B26D 5/00

USPC ..... 91/499, 500; 417/269, 270, 271, 273; 277/436–439

See application file for complete search history.

(56) References Cited

U.S. PATENT DOCUMENTS

| | | |
|---|---|---|
| 110,936 A | 1/1871 | Sheldon |
| 915,759 A | 3/1909 | Foll |

(Continued)

FOREIGN PATENT DOCUMENTS

| | | |
|---|---|---|
| JP | 2006063871 | 9/1994 |
| KR | 1019990079544 | 11/1999 |
| WO | 2007032703 | 3/2007 |

*Primary Examiner* — Charles Freay
*Assistant Examiner* — Patrick Hamo
(74) *Attorney, Agent, or Firm* — Trego, Hines & Ladenheim, PLLC

(57) ABSTRACT

An ultrahigh pressure pump includes a frame; a crankshaft having a journal; and at least one telescoping pump subassembly having inner and outer ends. The outer end is carried by the frame pivot so as to allow pivotal swinging movement of the pump subassembly, and the inner end is attached to the journal. The piston rod can reciprocate relative to the inner bore substantially free from side loads. The pump subassembly includes: an outer member including a cylinder defining an inner bore; and a inner member having a piston rod and a outer sleeve. The piston rod is received in the inner bore and the cylinder is received in the outer sleeve. First and second restraining elements are disposed at spaced-apart positions along the axis of the pump subassembly and are configured to oppose misalignment forces between the piston rod and the cylinder.

24 Claims, 21 Drawing Sheets

(51) Int. Cl.

| | |
|---|---|
| ***F04B 1/04*** | (2006.01) |
| ***F04B 1/113*** | (2006.01) |
| ***F04B 9/04*** | (2006.01) |
| ***F04B 53/16*** | (2006.01) |

(56) References Cited

U.S. PATENT DOCUMENTS

| | | | | | |
|---|---|---|---|---|---|
| 1,120,998 | A | | 12/1914 | Canode | |
| 1,159,066 | A | | 11/1915 | Moore | |
| 2,151,402 | A | | 3/1939 | Burch | |
| 2,347,663 | A | | 5/1944 | Carnahan | |
| 2,502,334 | A | | 3/1950 | Melchior | |
| 2,624,284 | A | | 1/1953 | Straub | |
| 2,642,748 | A | | 6/1953 | Widmer | |
| 2,660,493 | A | | 11/1953 | Flick | |
| 2,673,028 | A | | 3/1954 | Cornelius et al. | |
| 2,844,425 | A | | 7/1958 | Muller | |
| 2,934,363 | A | * | 4/1960 | Knox | 277/468 |
| 3,227,094 | A | | 1/1966 | Cailloux | |
| 3,323,467 | A | | 6/1967 | Heintz | |
| 3,338,170 | A | | 8/1967 | Swartz | |
| 3,601,419 | A | | 8/1971 | Fern | |
| 3,665,816 | A | | 5/1972 | Caudle | |
| 3,790,310 | A | | 2/1974 | Whelan | |
| 3,945,766 | A | | 3/1976 | Gelon | |
| 4,026,322 | A | | 5/1977 | Thomas | |
| 4,103,594 | A | | 8/1978 | Geffroy | |
| 4,304,531 | A | | 12/1981 | Fisher | |
| 4,310,290 | A | | 1/1982 | Dantlgraber et al. | |
| 4,371,001 | A | | 2/1983 | Olsen | |
| 4,389,168 | A | | 6/1983 | Yannascoli et al. | |
| 4,464,567 | A | | 8/1984 | Reilly et al. | |
| 4,536,135 | A | | 8/1985 | Olsen et al. | |
| 4,683,806 | A | | 8/1987 | Ryzner | |
| 4,717,317 | A | | 1/1988 | Hofer et al. | |
| 4,780,064 | A | | 10/1988 | Olsen | |
| 4,822,255 | A | | 4/1989 | Eickmann | |
| 4,957,416 | A | * | 9/1990 | Miller et al. | 417/273 |
| 5,037,277 | A | | 8/1991 | Tan | |
| 5,050,892 | A | | 9/1991 | Kawai et al. | |
| 5,380,159 | A | | 1/1995 | Olsen et al. | |
| 5,472,367 | A | | 12/1995 | Slocum et al. | |
| 5,493,954 | A | | 2/1996 | Kostohris et al. | |
| 5,508,596 | A | | 4/1996 | Olsen | |
| 5,892,345 | A | | 4/1999 | Olsen | |
| 6,464,567 | B2 | | 10/2002 | Hashish et al. | |
| 8,246,319 | B2 | | 8/2012 | Ohnishi | |
| 8,267,672 | B2 | * | 9/2012 | Kellar et al. | 417/271 |
| 2003/0122322 | A1 | | 7/2003 | Tremoulet, Jr. et al. | |

* cited by examiner

Fig. 13
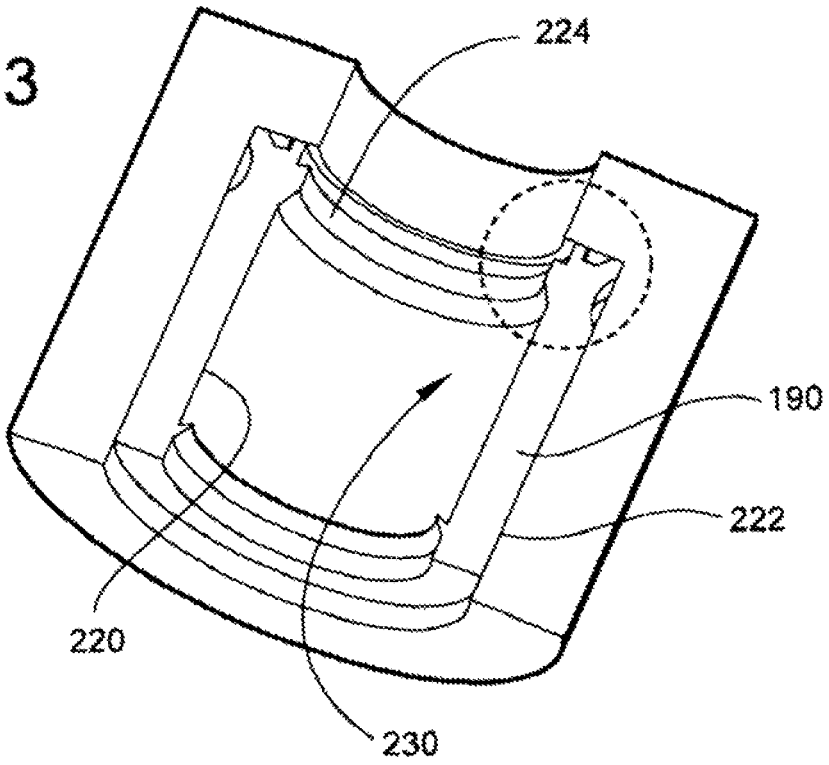
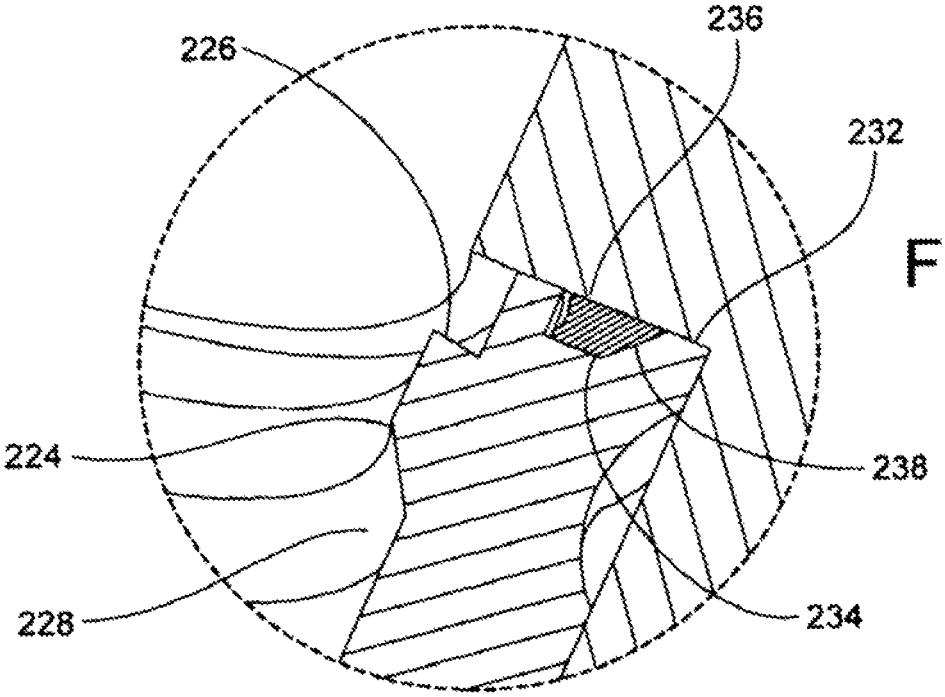
Fig. 14

HIGH PRESSURE PUMP

BACKGROUND OF THE INVENTION

This invention relates generally to ultrahigh-pressure pumps and more particularly to a piston-type ultrahigh pressure pump.

Ultrahigh pressure pumps are used for many industrial applications, for example for waterjet cutting and textile manufacturing. An ultrahigh-pressure pump delivers liquid flow at extremely high pressures, e.g. more than about 207 MPa (30,000 psi). There are two broad classes of pumps used to produce theses pressures in the prior art, namely intensifier pumps which utilize a hydraulically-operated set of intensifier pistons to pressurize water to ultrahigh-pressure levels, and crank-operated piston pumps which are similar in construction to automobile engines. Intensifier pumps operate at relatively low efficiency, for example about 60%. Crank pumps are more efficient, but have relatively low service lives.

Accordingly, there is a need for an ultrahigh-pressure pump which combines high efficiency and high component life.

BRIEF SUMMARY OF THE INVENTION

This need is addressed by the present invention, which provides an ultrahigh pressure pump having telescoping pump subassemblies which operate substantially without side loads thereupon.

According to one aspect of the invention, an ultrahigh pressure pump includes: a frame including a partial shell bearing; a crankshaft rotatably mounted in the frame, the crankshaft having a journal comprising a surface offset from a rotational axis of the crankshaft; at least one telescoping pump subassembly having inner and outer ends, wherein the outer end is carried by the outer frame pivot so as to allow pivotal swinging movement of the pump subassembly about the outer frame pivot, and the inner end is pivotally attached to the journal, such that the pump subassembly can reciprocate substantially without side loads thereupon, the pump subassembly including: an outer member having inner and outer ends, the outer end received in the partial shell bearing and the inner end including a cylinder having an inner bore formed therein and an elongated crossbar oriented substantially perpendicular to the cylinder, wherein an outer surface of the crossbar is received in the partial shell bearing and; a inner member having an inner pump pivot disposed at an inner end thereof, an outwardly extending piston rod, and a coaxial outer sleeve surrounding the piston rod in spaced-apart relationship thereto, wherein the piston rod is received in the inner bore and the cylinder is received in the outer sleeve; a first restraining element disposed at a first position along the axis of the pump subassembly, the first restraining element configured to oppose lateral misalignment forces between the piston rod and the cylinder; and a second restraining element disposed at a second position along the axis of the pump subassembly spaced away from the first position, the second restraining element configured to oppose lateral misalignment forces between the piston rod and the cylinder.

According to another aspect of the invention, an ultrahigh pressure pump includes: a frame including an outer frame pivot; a crankshaft rotatably mounted in the frame, the crankshaft having a journal comprising a surface offset from a rotational axis of the crankshaft wherein the journal is an eccentric shape; at least one telescoping pump subassembly having inner and outer ends, wherein the outer end is carried by the outer frame pivot so as to allow pivotal swinging movement of the pump subassembly about the outer frame pivot, and the inner end is pivotally attached to the journal, such that the pump subassembly can reciprocate substantially without side loads thereupon, the pump subassembly including: an outer member having inner and outer ends, the outer end received in the outer frame pivot and the inner end including a cylinder having an inner bore formed therein and; a inner member having an inner pump pivot disposed at an inner end thereof, an outwardly extending piston rod, and a coaxial outer sleeve surrounding the piston rod in spaced-apart relationship thereto, wherein the piston rod is received in the inner bore and the cylinder is received in the outer sleeve; a first restraining element disposed at a first position along the axis of the pump subassembly, the first restraining element configured to oppose lateral misalignment forces between the piston rod and the cylinder; and a second restraining element disposed at a second position along the axis of the pump subassembly spaced away from the first position, the second restraining element configured to oppose lateral misalignment forces between the piston rod and the cylinder.

According to another aspect of the invention, a telescoping pump sub-assembly includes: a cylinder having an inner bore formed therein, with a piston rod received in the inner bore; a high-pressure seal carried at an end of the cylinder for preventing fluid leakage between the piston rod and the inner bore, the high-pressure seal including an inner wall having a first diameter larger than an outside diameter of the piston rod, the inner wall comprising: a circumferential first sealing band having a second diameter smaller than the outside diameter of the piston rod, so as to create a preselected interference between the first sealing band and the piston rod; an axially-facing first annular surface joined to an upper end of the first sealing band; and an angled, circumferential first tapered surface joined to a lower end of the first sealing band, so as to define an annular first relief zone between the piston rod and the first tapered surface.

According to another aspect of the invention, a telescoping pump subassembly includes: a cylinder having an inner bore formed therein, with a piston rod received in the inner bore; a high pressure seal carried at an end of the cylinder for preventing fluid leakage between the piston rod and the inner bore, the high-pressure seal including an inner wall having a first diameter larger than an outside diameter of the piston rod, the inner wall comprising: a circumferential first sealing band having a second diameter smaller than the outside diameter of the piston rod, so as to create a preselected interference between the first sealing band and the piston rod; an axially-facing first annular surface joined to an upper end of the first sealing band; an angled, circumferential first tapered surface joined to a lower end of the first sealing band, so as to define an annular first relief zone between the piston rod and the first tapered surface; an axially-facing second annular surface axially displaced from the first annular surface; an annular groove formed in the second annular surface; and a resilient seal ring disposed in the second annular surface.

According to another aspect of the invention, a telescoping pump subassembly includes: a cylinder having an inner bore formed therein, with a piston rod received in the inner bore; a high pressure seal carried at an end of the cylinder for preventing fluid leakage between the piston rod and the inner bore, the high-pressure seal including an inner wall having a first diameter larger than an outside diameter of the piston rod, the inner wall comprising: a circumferential first sealing band having a second diameter smaller than the outside diameter of the piston rod, so as to create a preselected interference between the first sealing band and the piston rod; an axially-facing first annular surface joined to an upper end of the first sealing band; an angled, circumferential first tapered surface joined to a lower end of the first sealing band, so as to define an annular first relief zone between the piston rod and the first tapered surface; an axially-facing second annular surface axially displaced from the first annular surface; and an annular lip extending radially inwardly from the second annular surface.

According to another aspect of the invention, an ultrahigh pressure pump includes: a frame including an outer frame pivot; a crankshaft rotatably mounted in the frame, the crankshaft having a journal comprising a surface offset from a rotational axis of the crankshaft wherein the journal is an eccentric shape; at least one telescoping pump subassembly having inner and outer ends, wherein the outer end is carried by the outer frame pivot so as to allow pivotal swinging movement of the pump subassembly about the outer frame pivot, and the inner end is pivotally attached to the journal, the pump subassembly including: an outer member including: a cylinder having an inner bore; an elongated crossbar oriented substantially perpendicular to the cylinder and having a central bore which receives an outer end of the cylinder, the crossbar defining an outer pump pivot which is coupled to the outer frame pivot; and a valve cartridge received in the central bore opposite the cylinder, the valve cartridge including: an inlet passage having a first end communicating with the inner bore of the cylinder, and an inlet check valve disposed in the inlet passage; and an outlet passage having a first end communicating with the inner bore of the cylinder, and an outlet check valve disposed in the outlet passage; and a inner member having an inner pump pivot disposed at an inner end thereof which is coupled to the journal, an outwardly extending piston rod, and a coaxial outer sleeve surrounding the piston rod in spaced-apart relationship thereto, wherein the piston rod is received in the inner bore and the cylinder is received in the outer sleeve.

According to another aspect of the invention, an ultrahigh pressure pump includes: a frame including a partial shell bearing; a crankshaft rotatably mounted in the frame, the crankshaft having a journal comprising a surface offset from a rotational axis of the crankshaft wherein the journal is an eccentric shape; at least one telescoping pump subassembly having inner and outer ends, wherein the outer end is carried by the partial shell bearing so as to allow pivotal swinging movement of the pump subassembly about the outer frame pivot, and the inner end is pivotally attached to the journal, the pump subassembly including: an outer member including: a cylinder having an inner bore; an elongated crossbar oriented substantially perpendicular to the cylinder and having a central bore which receives an outer end of the cylinder, the crossbar defining an outer pump pivot which is coupled to the outer frame pivot; and a valve cartridge received in the central bore opposite the cylinder, the valve cartridge including: an inlet passage having a first end communicating with the inner bore of the cylinder, and an inlet check valve disposed in the inlet passage; and an outlet passage having a first end communicating with the inner bore of the cylinder, and an outlet check valve disposed in the outlet passage; and a inner member having an inner pump pivot disposed at an inner end thereof which is coupled to the journal, an outwardly extending piston rod, and a coaxial outer sleeve surrounding the piston rod in spaced-apart relationship thereto, wherein the piston rod is received in the inner bore and the cylinder is received in the outer sleeve.

BRIEF DESCRIPTION OF THE DRAWINGS

The invention may be best understood by reference to the following description taken in conjunction with the accompanying drawing figures in which:

FIG. 13 is a perspective cut-away view of an alternative high-pressure seal assembly for use with the present invention;

FIG. 14 is an enlarged view of a portion of the high-pressure seal assembly of FIG. 13;

DETAILED DESCRIPTION OF THE INVENTION

Figure 1:
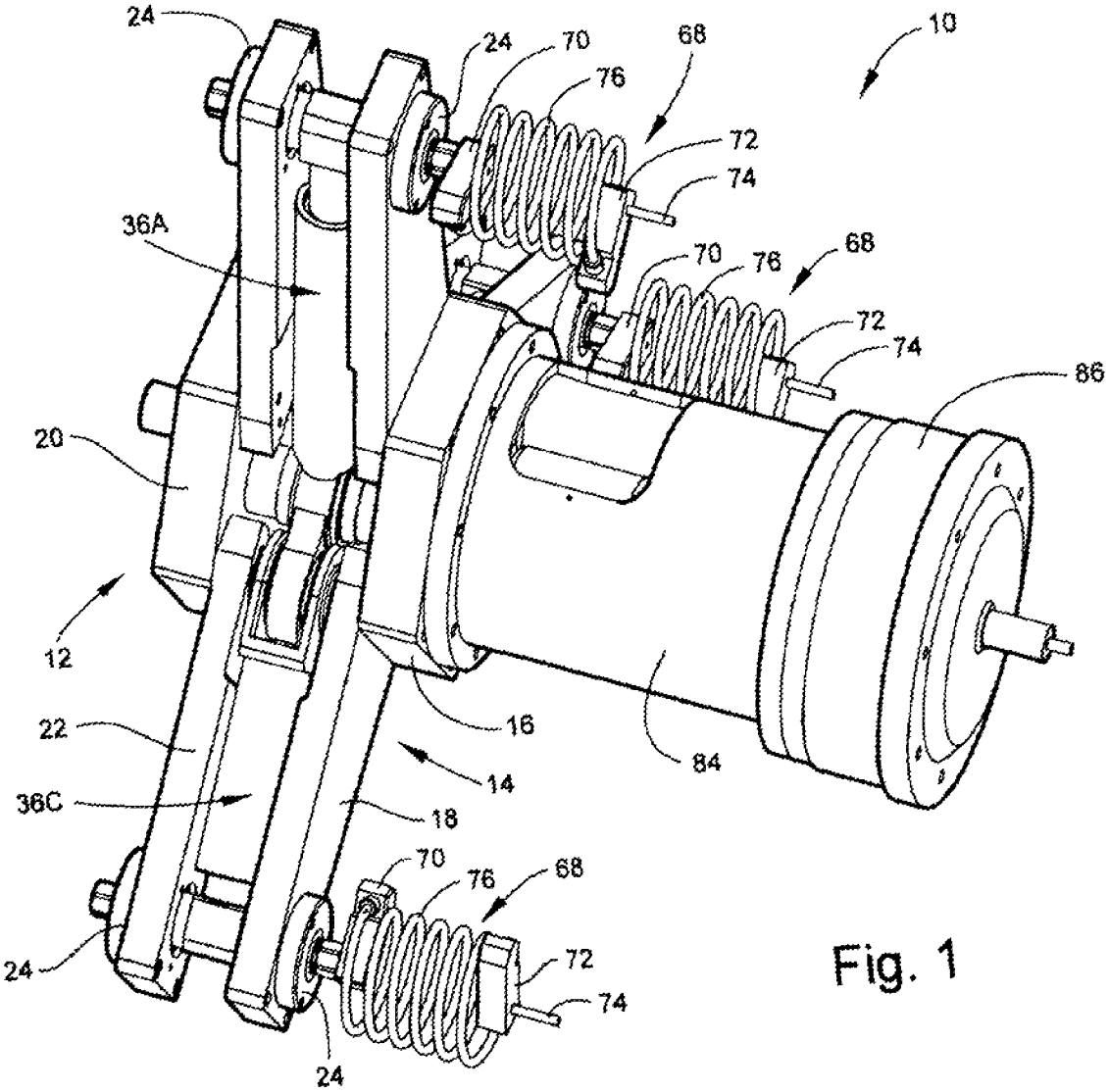
FIG. 1 is a perspective view of an ultrahigh-pressure pump constructed in accordance with the resent invention.
Figure 2:
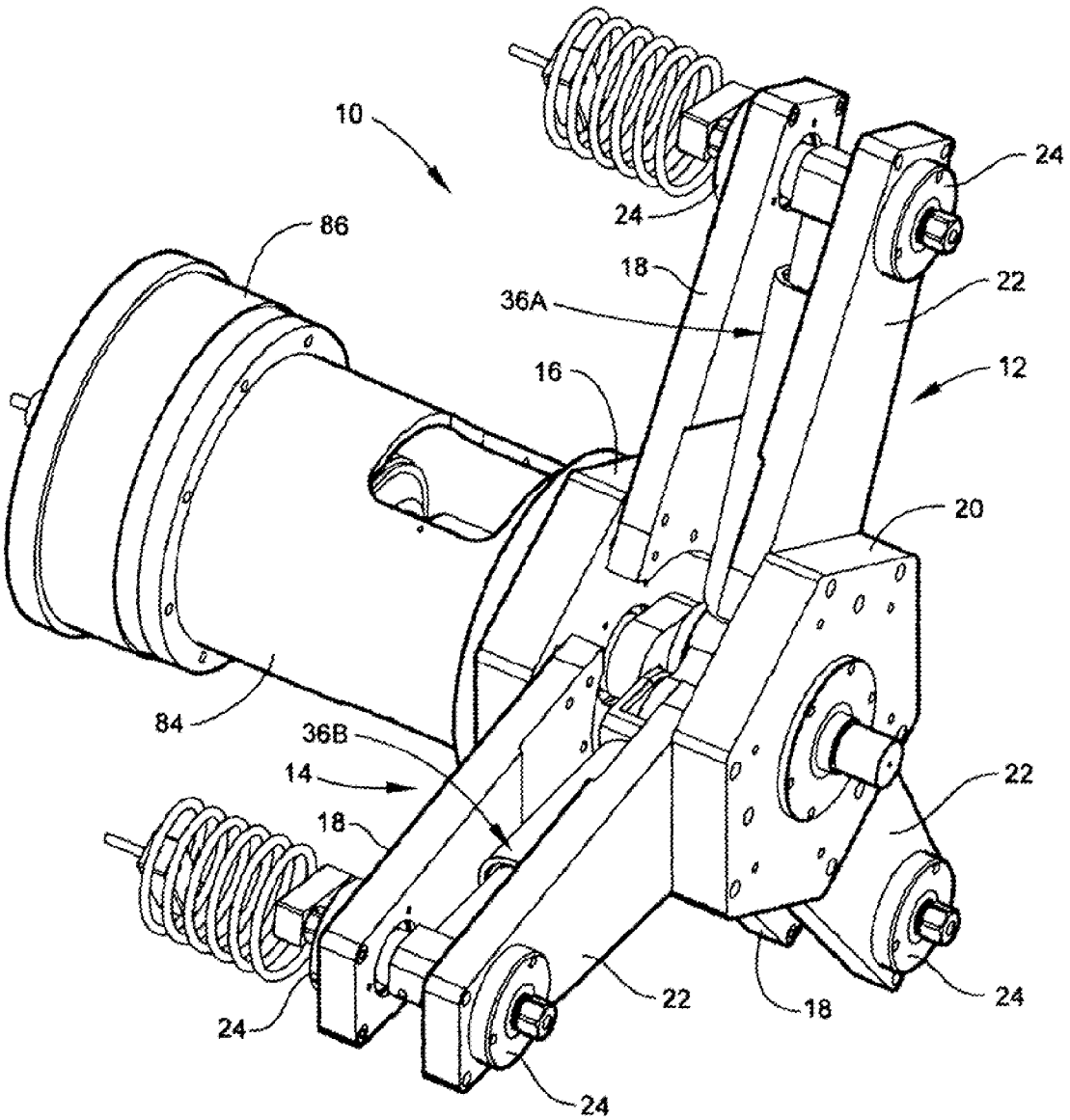
FIG. 2 is another perspective view of the pump of FIG. 1.

Referring to the drawings wherein identical reference numerals denote the same elements throughout the various views, FIGS. 1-4 illustrate an exemplary ultrahigh-pressure pump 10 constructed according to the present invention. The pump 10 includes spaced-apart structural front and rear frames 12 and 14. The rear frame 14 includes a rear hub plate 16 and at least one rear frame arm 18 extending radially outwardly therefrom. The front frame 12 includes a front hub plate 20 and at least one front frame arm 22 extending radially outwardly therefrom. Each of the front and rear frame arms 18 and 22 carries an outer frame pivot 24 near its radially outer end. In the illustrated example, there are three equally-spaced rear frame arms 16 and three equally-spaced front frame arms 22.

Figure 3:
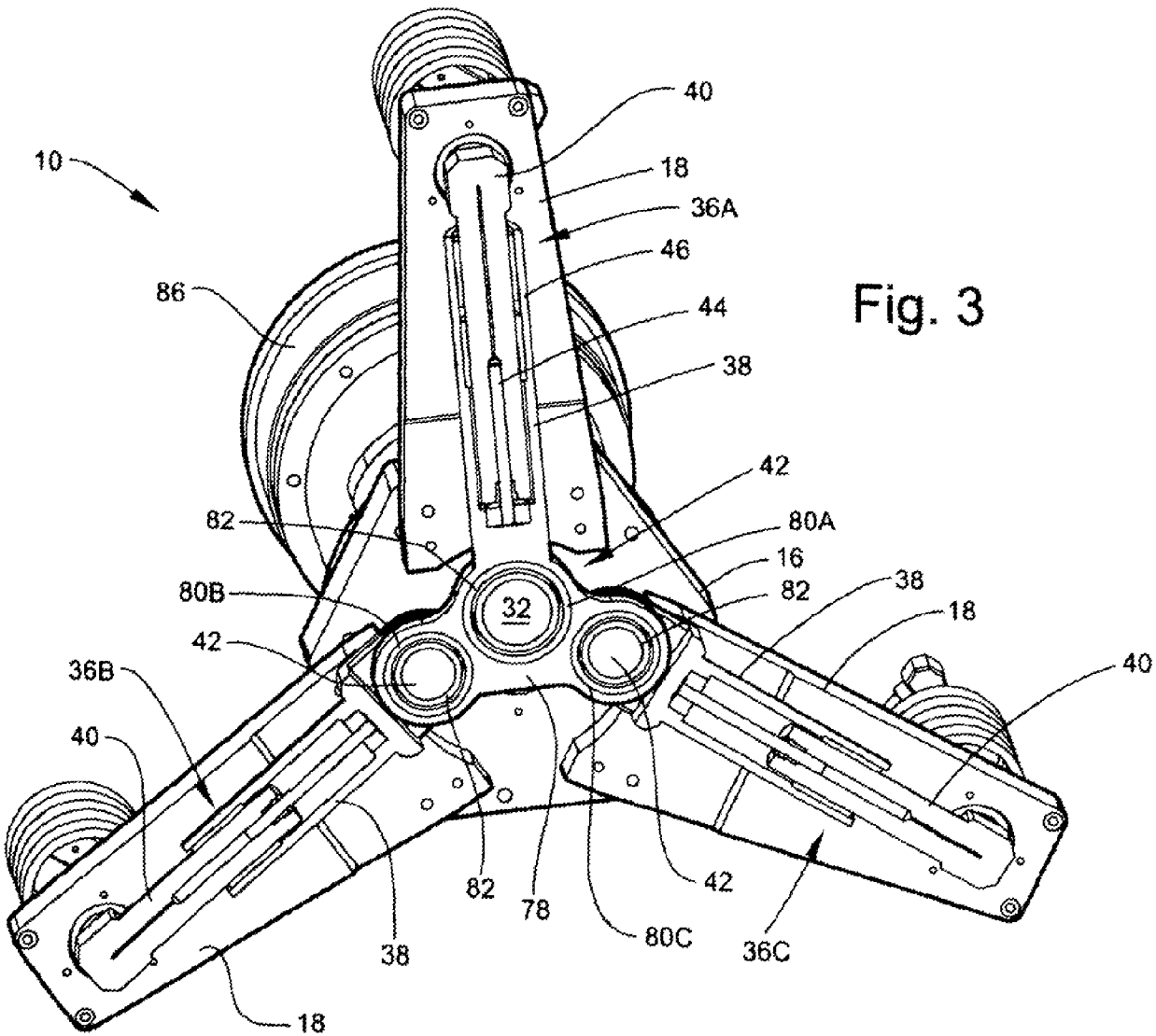
FIG. 3 is a partially cut-away perspective view of the pump of FIG. 1.
Figure 4:
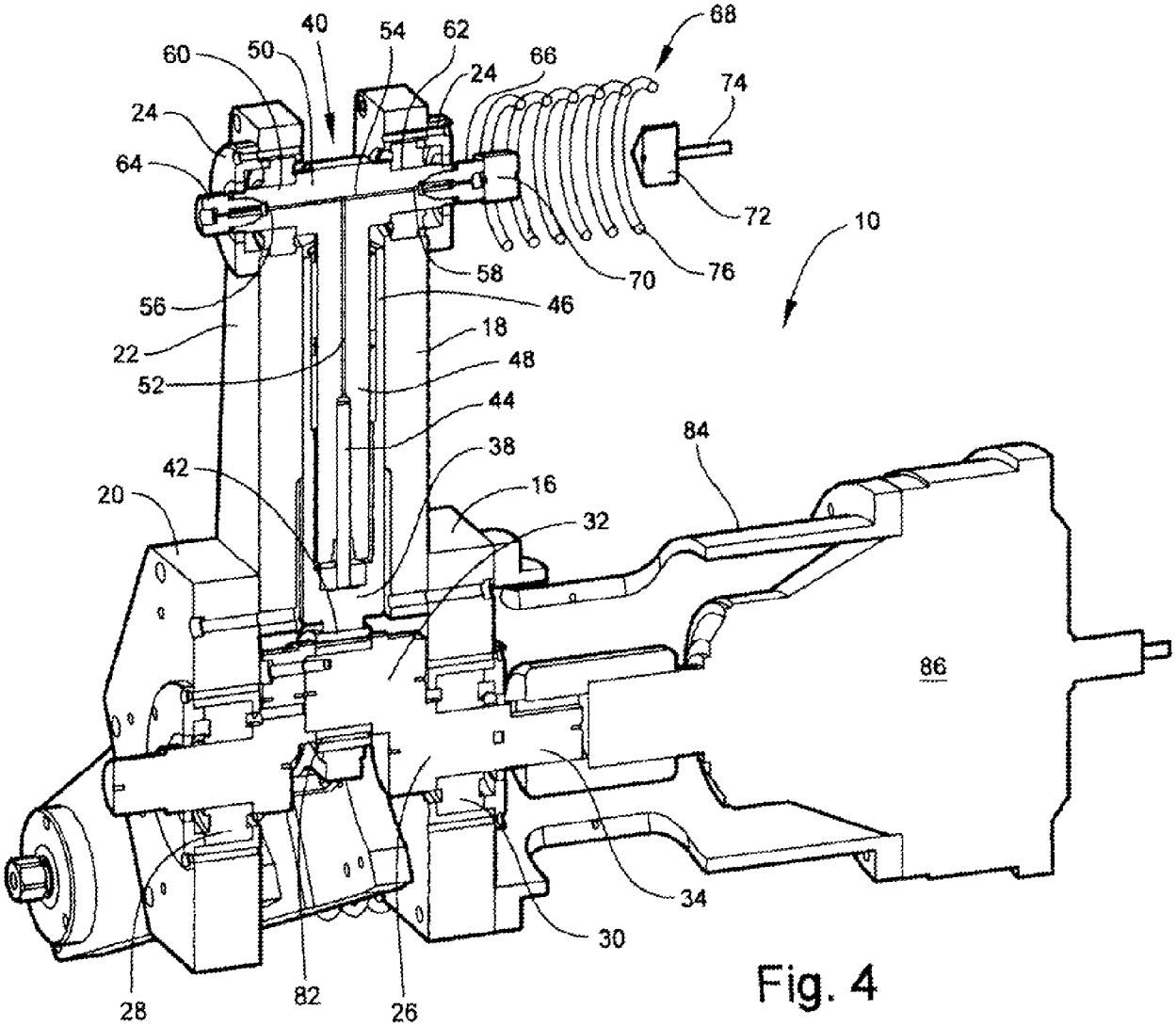
FIG. 4 is a perspective cross-sectional view of the pump of FIG. 1.

As shown in FIGS. 3 and 4, a crankshaft 26 is carried in bearings 28 and 30, for example rolling-element bearings, mounted in the front and rear hub plates 20 and 16, respectively, so that it can freely rotate relative to the front and rear frames 12 and 14. The crankshaft 26 includes an offset crankpin 32. One end of the crankshaft 26 is adapted to be driven by an external power source and is referred to as a input shaft 34.

The pump 10 includes at least one pump subassembly referred to generally at 36. In the illustrated example there are first, second, and third equally-spaced pump subassemblies 36A, 36B, and 36C. A larger or smaller number of pump subassemblies 36 may be used to suit a particular application. Each pump subassembly 36 comprises telescoping inner and outer members 38 and 40. For the purposes of explanation, only the first pump subassembly 36A will be described in detail, with the understanding that it is representative of the construction of the other pump subassemblies 36A and 36B. The inner member 38 has an inner pivot 42 disposed at its radially inner end. A cylindrical piston rod 44 extends radially outwardly from the inner member 38, and a concentric outer sleeve 46 surrounds the piston rod 44.

The outer member 40 is generally "T" shaped and includes a radially-extending cylinder 48 and a crossbar 50. The cylinder 48 has an inner bore 52 formed therein. When assembled, the piston rod 44 fits into the inner bore 52 and the cylinder 48 fits into the outer sleeve 46. The crossbar 50 has an interior crossbore 54 having front and rear ends 56 and 58, which connects to the inner bore 52, and an outer surface which forms front and rear outer pump pivots 60 and 62.

An inlet check valve 64 is installed in fluid communication with the front end 56 of the crossbore 54, and an outlet check valve 66 is installed in fluid communication with the rear end 58 of the crossbore 54, so as to allow flow from the front end of the crossbore 54 to the rear end of the crossbore 54, but to prevent flow in the opposite direction. The inlet check valve 64 is connected to an inlet tube (not shown), for example using a rotary union joint of a known type, and the outlet check valve 66 is connected to a flexible discharge tube assembly 68.

The discharge tube assembly 68 includes a hollow first block 70 connected to the outlet check valve 66, and a hollow second block 72 having a discharge stub 74 which can be connected to appropriate downstream piping. The first and second blocks 70 and 72 are connected by a coiled tube 76. The coiled tube 76 has several complete turns. This accommodates the pivoting motion of the pump subassembly 36 as described below, while keeping the strain in the coiled tube 76 relatively small. This helps prevent failure of the coiled tube 76, especially when it is filled with high-pressure working fluid. A suitable high pressure rotary union could be substituted for the discharge tube assembly 68.

As shown in FIG. 3, the inner pivot 42 of each pump subassembly 36 is connected to the crankshaft 26 through a yoke 78 which is attached to the crankpin 32. The yoke 78 is a "Y"-shaped member including first, second, and third crank pivots 80A, 80B, and 80C. The inner pivots 42 of the second and third pump subassemblies 36B and 36C are attached to the yoke 78 so that they can pivot relative to the yoke 78, for example using rolling-element bearings 82. A provision may be made for ensuring colinearity of the piston rod 44 and cylinder 48. For example, the inner pivots 42 may be mounted to the bearings 82 so that some longitudinal (i.e. fore-and-aft) motion is allowed. Alternatively, the bearings 82 may be of a type which permits some angular displacement to achieve the same purpose. In the illustrated example, the inner member 38 of the first pump subassembly 36A is integrally formed with the yoke 78. Thus, the inner pivot 42 of the first pump subassembly 36A, the first crank pivot 80A, and the crankpin 32 are all coaxial.

In the illustrated example, the pump 10 includes a housing 84 attached to the rear frame 14. The housing 84 carries a speed reducer 86 of a known type which is coupled to the input shaft 34, and adapted to be driven by an electric motor (not shown). Alternatively, any kind of power source could be used to turn the input shaft 34.

Figures 5, 6, 7:
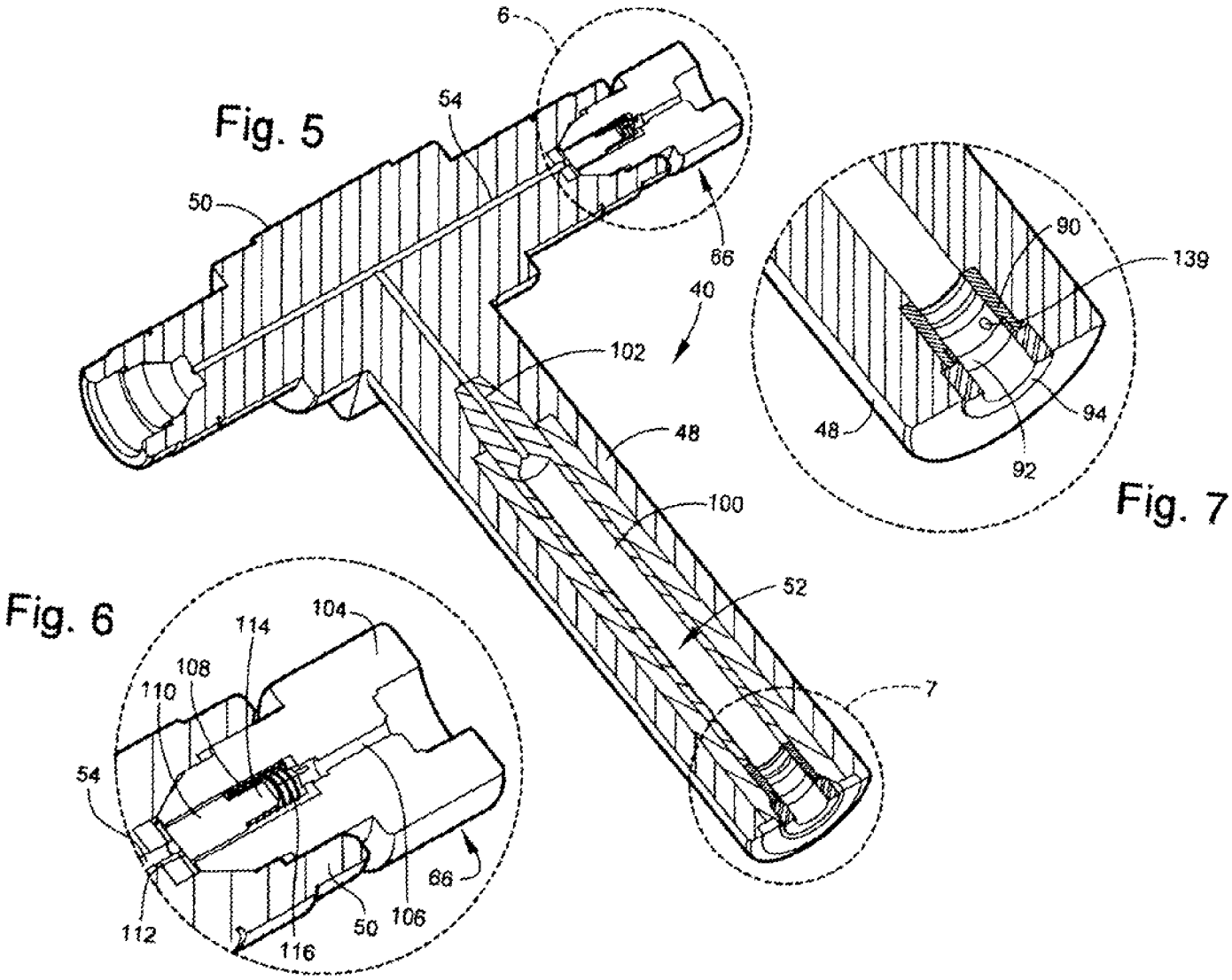
FIG. 5 is a cut-away view of an inner member of a pump subassembly.
FIG. 6 in an enlarged view of a portion of FIG. 5.
FIG. 7 is an enlarged view of another portion of FIG. 5.
Figure 8:
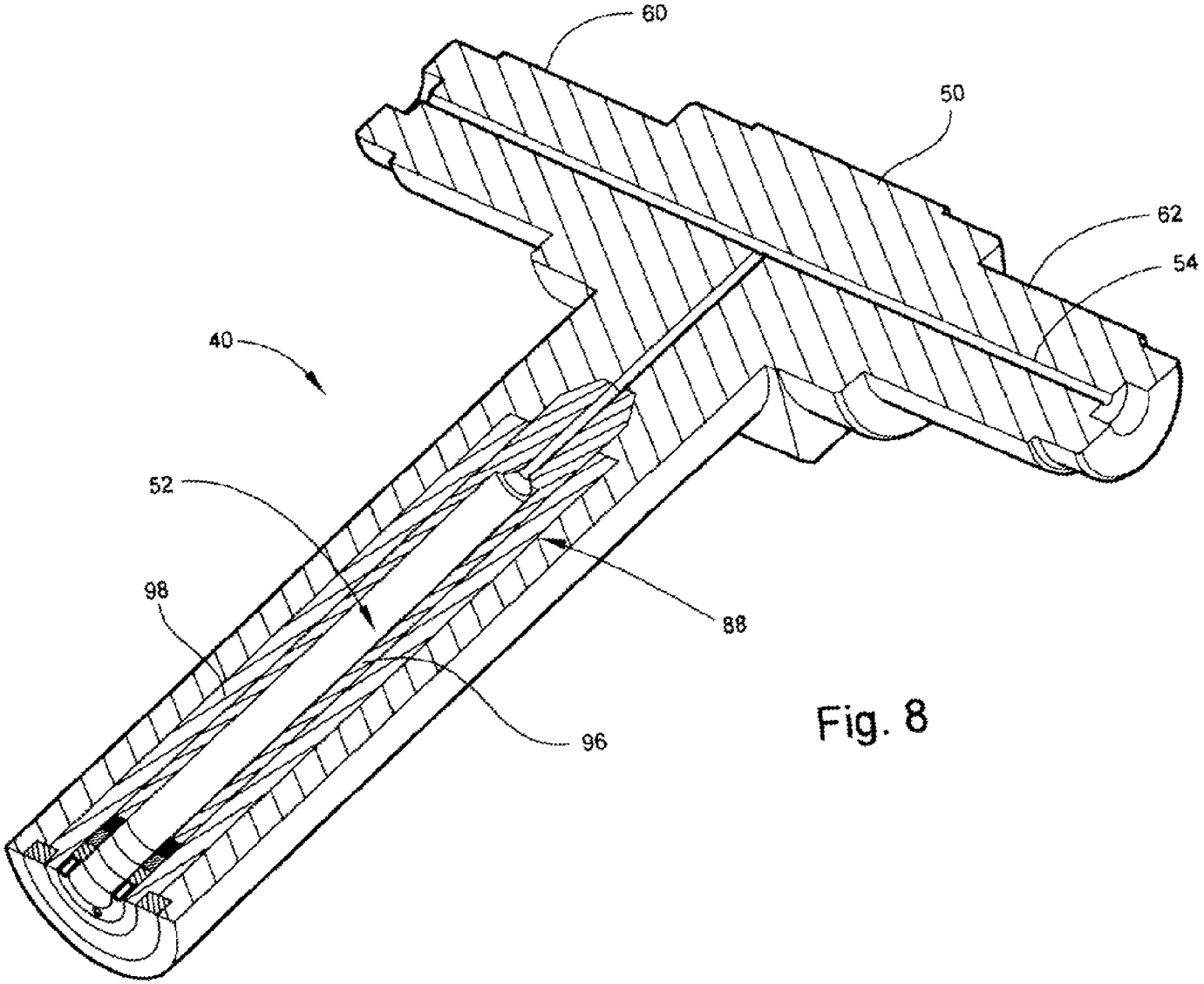
FIG. 8 is another cut-away view the inner member of FIG. 5 showing a liner assembly installed therein.

The outer member 40 is shown in more detail in FIGS. 5 and 8. The cylinder 48 receives a liner assembly 88, a high-pressure seal 90, a low-pressure secondary seal 92, and a locking ring 94. The high-pressure seal 90 may be a resilient seal of a known type, for example a flexible polymer. Preferably, though, it is of a type described more detail below. The secondary seal 92 will trap any water that makes it past the high pressure seal 90 and will force any low pressure leakage flow into the lateral drain path (described below) which leads to an external drain and/or lubrication channel. The liner assembly 88 comprises an inner liner 96 through which the inner bore 52 passes, and an outer liner 98 that is coaxial with the inner liner 96. The inner bore 52 has a lower portion 100 sized to snugly receive the piston rod 44, and a smaller-diameter upper portion 102 which connects to the crossbore 54. There is a controlled interference fit between the inner liner 96 and the outer liner 98, and they are assembled together by known methods such as press fitting or by heating the outer liner 98 to expand it and then placing it over the inner liner 96. This results in the tangential stresses in the inner liner 96 being compressive at the inner bore 52. The stresses in the inner liner 96 will remain compressive until the working pressure in the inner bore 52 exceeds the preload stress. This arrangement resists cracking and failure of the inner liner 96 and is a more efficient use of material than if the cylinder 48 were a unitary structure. This compound construction inner liner 96 and the outer liner 98 may be extended to more than two cylindrical elements. For example, one or more intermediate liners (not shown) could be disposed between the inner liner 96 and the outer liner 98. The inner liner 96 is also longer than the outer liner 98. Therefore, the stress risers present at the termination of the inner and outer liners 96 and 98 are not concentrated at the same location along the length of the cylinder 48.

FIG. 6 illustrates the outlet check valve 66 in more detail. The outlet check valve 66 has a body 104 which is received in the front end of the crossbar 50 of the outer member 40. A central passage 106 is formed through the body 104 and connects to the crossbore 54. A valve chamber 108 houses a moveable plunger 110 which has a sealing face 112 and a protruding stem 114. A return spring 116 is mounted around the stem 114 and urges the sealing face 112 against a valve seat 118 which disposed between the crossbar 50 and the body 106. The valve body 106, plunger 110, and seat 118 are made from a material which offers good resistance to abrasion and wear. One example of a suitable material is a sintered ceramic, or a microgram carbide or Cerbide (ceramic and carbide hybrid material). The inlet check valve 64 is substantially identical in construction to the outlet check valve 66, except that the orientation of its plunger and return spring (not shown) are reversed relative to those of the outlet check valve 66.

Figure 9:
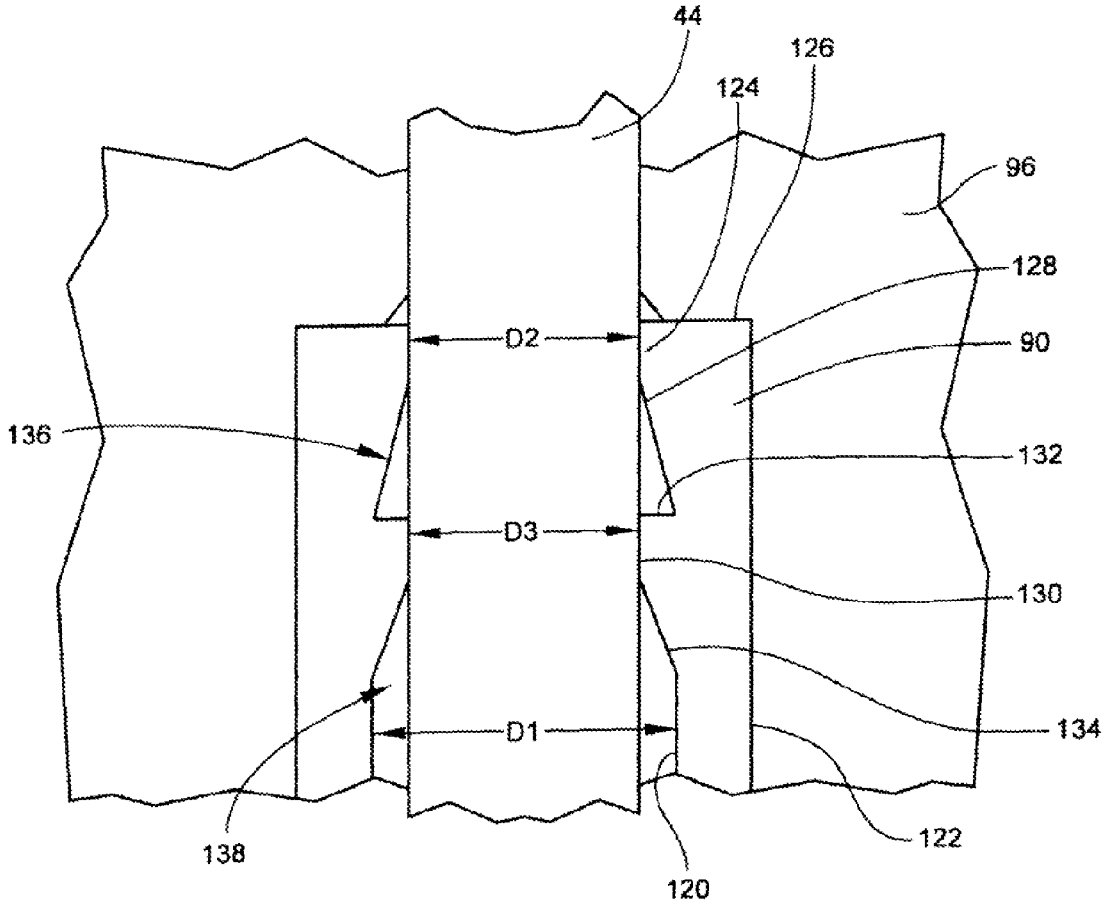
FIG. 9 is an enlarged cross-sectional view of an inner cylinder liner, high-pressure seal, and piston rod.

FIG. 9 shows one preferred construction of the high-pressure seal 90 in more detail. The high-pressure seal 90 is generally cylindrical and has an inner wall 120 and an outer wall 122. The inner wall 120 has a nominal inside diameter "D1" which is larger than the outside diameter of the piston rod 44. The inner wall 120 includes a circumferential surface denoted as a first sealing band 124 having a reduced inside diameter "D2". Diameter D2 is selected to create a slight interference fit between the first sealing band 124 and the piston rod 44. For example, the amount of diametrical interference may be about 0.005 cm (0.002 in.) to about 0.007 cm (0.003 in.) The upper end of the first sealing band 124 joins an axially-facing first annular surface 126, and the lower end of the first sealing band 124 joins a first tapered surface 128 which gradually tapers out to the nominal diameter D1.

The inner wall 120 also includes another circumferential surface denoted as a second sealing band 130 having a reduced inside diameter "D3". Diameter D3 is selected to create a slight interference fit between the second sealing band 130 and the piston rod 44. For example, the amount of diametrical interference may be about 0.005 cm (0.002 in.) to about 0.007 cm (0.003 in.) The upper end of the second sealing band 130 joins an axially-facing second annular surface 132, and the lower end of the second sealing band 130 joins a second tapered surface 134 which gradually tapers out to the nominal diameter D1. The high-pressure seal 88 is constructed from a material having a high resistance to wear. Examples of suitable materials includes a STELLITE cobalt-based alloy, or partially stabilized zirconia, with or without an anti-wear coating applied thereto, such as a hard carbon wear resistance coating.

As noted above, there is a slight interference fit between the first and second sealing bands 124 and 130 and the outer surface of the piston rod 44. This interference condition tends to resist leakage of the high-pressure working fluid. The first and second tapered surfaces 128 and 134 create generally annular first and second relief zones 136 and 138, respectively. The relief zones 136 and 138 collect any working fluid which may leak pass the sealing bands 124 and 130. This bypass flow may be collected through a drain system (not shown) connected to one or more ports 139 which open to the relief zones 136 or 138 and fed back to the pump 10. The flow through the ports 139 may optionally be monitored as a leak detection mechanism. For example, the volumetric flow rate through the drain system may be measured in a known manner. A threshold flow rate may be predetermined based on the degree of acceptable leakage through the high pressure seal 90. If the flow rate exceeds this threshold value, it is an indicator of excessive leakage. Appropriate means may be provided for displaying the actual flow rate and/or alerting a user to the presence of excessive drainage flow. The relief zones 136 and 138 may also be used to hold lubricant, such as oil, delivered through ports (not shown) similar to ports 139, from a lubricant supply (not shown) of a known type, such as a reservoir and pump. The lubricant reduces friction between the piston rod 44 and the high-pressure seal 88, but is isolated from the working fluid to prevent contamination thereof.

FIG. 13 illustrates an alternative embodiment 190 of a high-pressure seal which may be substituted for the high-pressure seal 88. The high-pressure seal 190 is constructed from a material having a high resistance to wear. One example of a suitable material is a STELLITE cobalt-based alloy, with or without an anti-wear coating applied thereto. The high-pressure seal 190 is generally cylindrical and has an inner wall 220 and an outer wall 222. The inner wall 220 has a nominal inside diameter which is larger than the outside diameter of the piston rod 44. The inner wall 220 includes a circumferential surface denoted as a sealing band 224 having a reduced inside diameter selected to create a slight interference fit between the sealing band 224 and the piston rod 44, as described above with respect to the first sealing band 124 of the high-pressure seal 88.

The upper end of the sealing band 224 joins an axially-facing first annular surface 226, and the lower end of the sealing band 224 joins a tapered surface 228 which gradually tapers out to the nominal diameter. The tapered surface 228 creates a generally annular relief zone 230 which collects any working fluid which may leak pass the sealing band 224. This bypass flow may be collected through a drain system (not shown) and fed back to the pump 10. The relief zone 230 may also be used to hold lubricant, such as oil, from a supply (not shown). The lubricant reduces friction between the piston rod 44 and the high-pressure seal 190, but is isolated from the working fluid to prevent contamination thereof.

As shown in FIG. 14, the high-pressure seal 190 also includes an axially-facing second annular surface 232, which is axially displaced from the first annular surface 224. The second annular surface 232 mates against the interior of the inner liner 96. At least one annular groove 234 is formed in the second annular surface 232. Each annular groove 234 receives a resilient seal ring 236, which may be formed from a high-Durometer polymer or a similar material. The seal ring 236 serves to prevent leakage past the high-pressure seal 190. The dimensions of the seal ring 236 are chosen so that it is slightly compressed when the high-pressure seal 190 is installed in the inner liner 96. This preload, plus the action of the high-pressure working fluid, tends to drive the seal ring 236 radially outward against an annular wedge surface 238 of the groove 234. This action tends to force the seal ring 236 into a tighter seal and improve its resistance to leakage.

Figure 15:
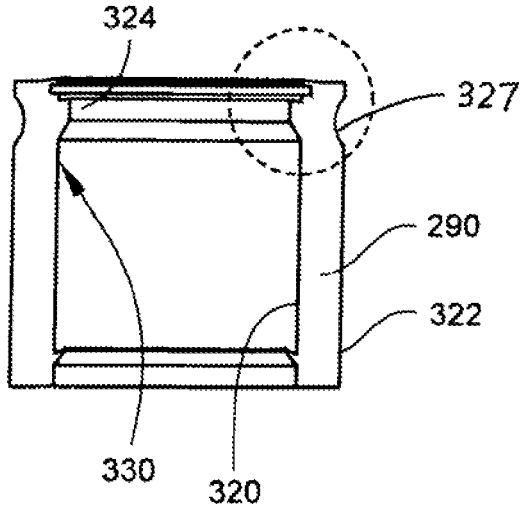
FIG. 15 is a perspective cut-away view of another alternative high-pressure seal assembly for use with the present invention.

FIG. 15 illustrates another alternative embodiment 290 of a high-pressure seal which may be substituted for the high-pressure seal 88. The high-pressure seal 290 is constructed from a material having a high resistance to wear. One example of a suitable material is a STELLITE cobalt-based alloy, with or without an anti-wear coating applied thereto. The high-pressure seal 290 is generally cylindrical and has an inner wall 320 and an outer wall 322. The inner wall 320 has a nominal inside diameter which is larger than the outside diameter of the piston rod 44. The inner wall 320 includes a circumferential surface denoted as a sealing band 324 having a reduced inside diameter selected to create a slight interference fit between the sealing band 324 and the piston rod 44, as described above with respect to the first sealing band 124 of the high-pressure seal 88. The outer wall includes support land 325 disposed around its upper end, which provides an extremely rigid interface between the high-pressure seal 290 and the cylinder 48. This may be an interference-type fit if desired. This ensures minimal motion or deflection when the space which receives the high-pressure seal 290 is pressurized during each pump cycle.

The outer wall also has a concave relief groove 327 formed therein. The relief groove 327 allows for minor dynamic motion adjacent to the sealing band 324, thus allowing the sealing band 324 to engage the piston rod 44 with a predetermined preload, and helps to reduce the effective stiffness of the high-pressure seal 290 in the region of the sealing band 324. The dimensions and shape of the relief groove 327 can be varied to reduce the stiffness of the sealing band 324 to piston rod engagement zone, thereby allowing a prescribed sealing force. The presence of the relief groove 327 allows a reduction in the slope of the deflection to opposing force curve from what would otherwise be required. That is, the high-pressure seal 290 has some flexure versus a rigid, solid wall.

The upper end of the sealing band 324 joins an axially-facing first annular surface 326, and the lower end of the sealing band 324 joins a tapered surface 328 which gradually tapers out to the nominal diameter. The upper surface of the sealing band 324 forms an angle "A" with the longitudinal axis of the high-pressure seal 290. In the illustrated example the angle A is about is 78.degree., but may be varied depending on the particular application. This angle, as well as the surface area of the axially-facing portion of the sealing band 324, may be varied to allow the working fluid pressure to actually push the sealing band 324 against the piston rod 44. The greater the pressure, the higher the sealing force. The tapered surface 328 creates a generally annular relief zone 330 which collects any working fluid which may leak past the sealing band 324. This bypass flow may be collected through a drain system (not shown) and fed back to the pump 10. The relief zone 330 may also be used to hold lubricant, such as oil, from a supply (not shown). The lubricant reduces friction between the piston rod 44 and the high-pressure seal 290, but is isolated from the working fluid to prevent contamination thereof.

Figure 16:
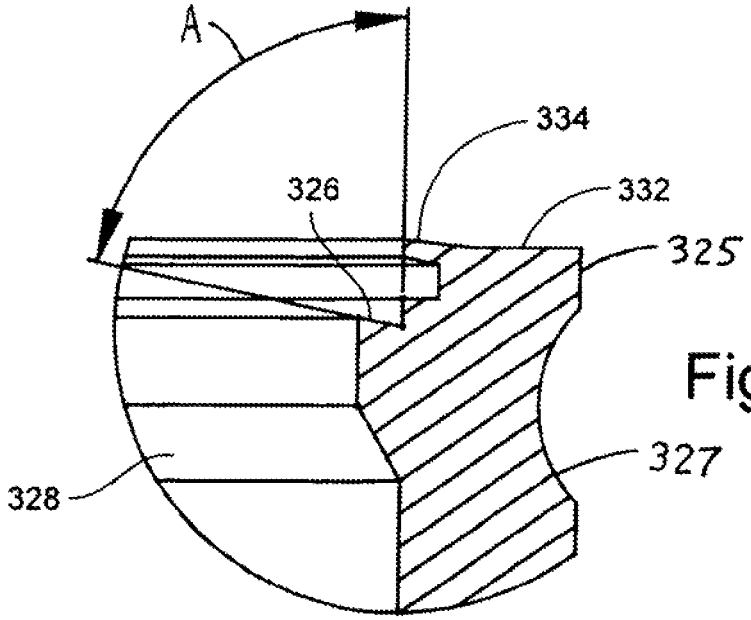
FIG. 16 is an enlarged view of a portion of the high-pressure seal assembly of FIG. 15.

As shown in FIG. 16, the high-pressure seal 290 also includes an axially-facing second annular surface 332, which is axially displaced from the first annular surface 324. The second annular surface 332 mates against the interior of the inner liner 96. An annular, radially-inwardly extending lip 334 is formed in the second annular surface 332 The lip 334 serves to prevent leakage past the high-pressure seal 290. The dimensions of the lip 334 are chosen so that it is slightly compressed when the high-pressure seal 290 is installed in the inner liner 96. This preload, plus the action of the high-pressure working fluid, tends to drive the lip 334 outward against inner liner 96, improve its resistance to leakage, and also ensuring that the lip 334 is in a state of compressive stress. This improves its resistance to fatigue and cracking.

The pump 10 operates as follows. Beginning with the piston rod 44 at a top dead center position (TDC), the crankshaft 26 rotates (for example, clockwise). The inner pivot 42 swings outward to the right (as viewed in FIG. 3) while the piston rod 44 moves radially inward, drawing fluid into the inner bore 52. The pump subassembly 363 is able to pivot in an arc about the outer frame pivot 24 so that the inner pivot 42 is displaced laterally from a radially-aligned position by a distance equal to the offset of the crankpin 32. As the piston rod 44 approaches a bottom dead center position (BDC), the inner pivot swings back into a position in radial alignment with the outer frame pivot 24, and the maximum volume of fluid is contained in the inner bore 52. As the crankshaft 26 continues to rotate, the inner pivot swings out the left and the piston rod 44 moves radially outward, expelling the fluid ahead of it. As the piston rod 44 approaches TDC again, the inner pivot 42 swings back into a position in radial alignment with the outer frame pivot 24. Any lateral force placed on the pump subassembly 36 as the crank cycles is relieved by pivoting motion of the pump subassembly 36. This virtually eliminates any side load between the piston rod 44 and inner bore 52, which increases component life and avoids premature seal leakage. It also allows for a relatively long stroke while maintaining a robust supporting structure, in contrast to a prior art piston and rod arrangement which requires significant clearance for the rod motion.

This configuration, with each pump subassembly 36 operating 1200 out of phase from the previous one, allows smooth, efficient pumping action with very low pulsing of the flow. The primary advantage of the robust construction is the ability to provide a required flow and pressure at a much lower operating speed than a prior art ultrahigh pressure crank pump. For example, the crank speed may be about 1/20th of that of a crank pump. The piston rod 44 is larger than the piston of a prior art crank pump, and the stroke is about 3⅓ times greater.

Figure 10:
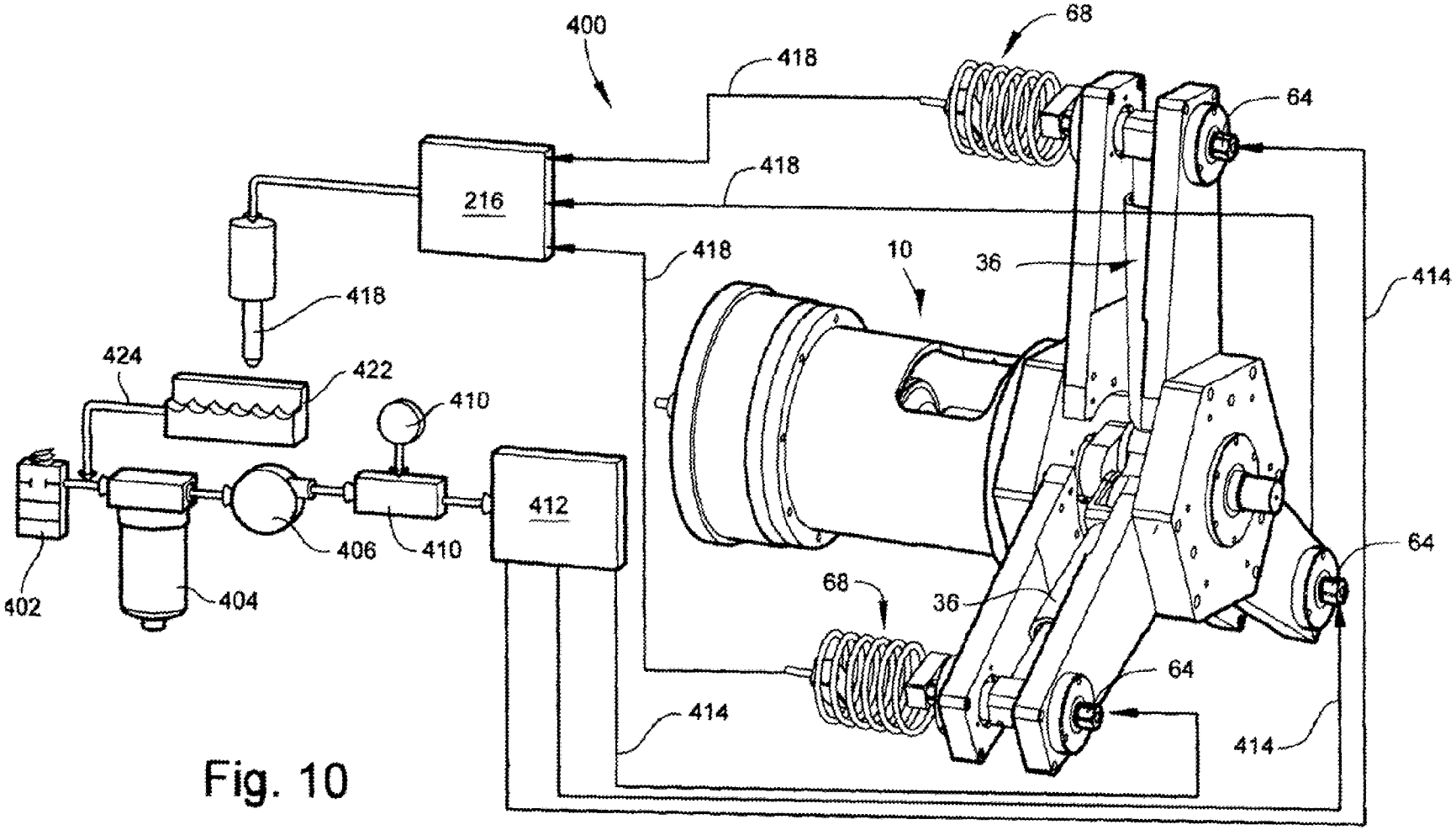
FIG. 10 is a schematic view of a waterjet cutting apparatus utilizing the pump of FIG. 1.

FIG. 10 illustrates schematically a waterjet cutting system 400 utilizing the pump 10 described above. The cutting system 400 includes, in flow sequence, a water supply 402 (e.g. municipal tap water or a tank), a supply filter 404, a low pressure boost pump 406, an optional additive manifold 408 connected to an optional additive pump 410, and an inlet manifold 412. The pump inlet check valve 64 of each pump subassembly 36 is connected to the inlet manifold 412 by a pump supply line 414. The pump outlet check valve 66 of each pump subassembly 36 is also connected to an outlet manifold 416 by a pump discharge line 418. A nozzle 420 is connected to the outlet manifold 416 by appropriate piping. A recovery tank 422 is mounted so as to receive the nozzle discharge flow. A drain line 424 is connected from the recovery tank 422 to the line leading into the supply filter 404.

The waterjet cutting system 400 operates as follows. Water from the water supply 402, the recovery tank 422, or both, passes through the boost pump 406 which increases its pressure and assures constant flow. The water is discharged into the additive manifold 408 where additives such as abrasives may be injected into the water flow by the additive pump 410. The water then passes through the inlet manifold 412 and the pump supply lines 414 into the pump 10 where its pressure is increased to an ultrahigh level, for example about 207 MPa (30,000 psi), as described in detail above. Even higher pressure levels, such as 414 MPa (60,000 psi) or even 620 MPa (90,000 psi) are possible. The pump discharge is directed through the pump discharge lines 408 and the outlet manifold to the nozzle 420. The nozzle 420 discharges a focused, ultrahigh-pressure discharge stream which can be used for purposes such as cutting a workpiece (not shown). The waste water is then collected in the recovery tank 422. Some or all of the recovered water may be reused through the pump cycle again.

Figure 11:
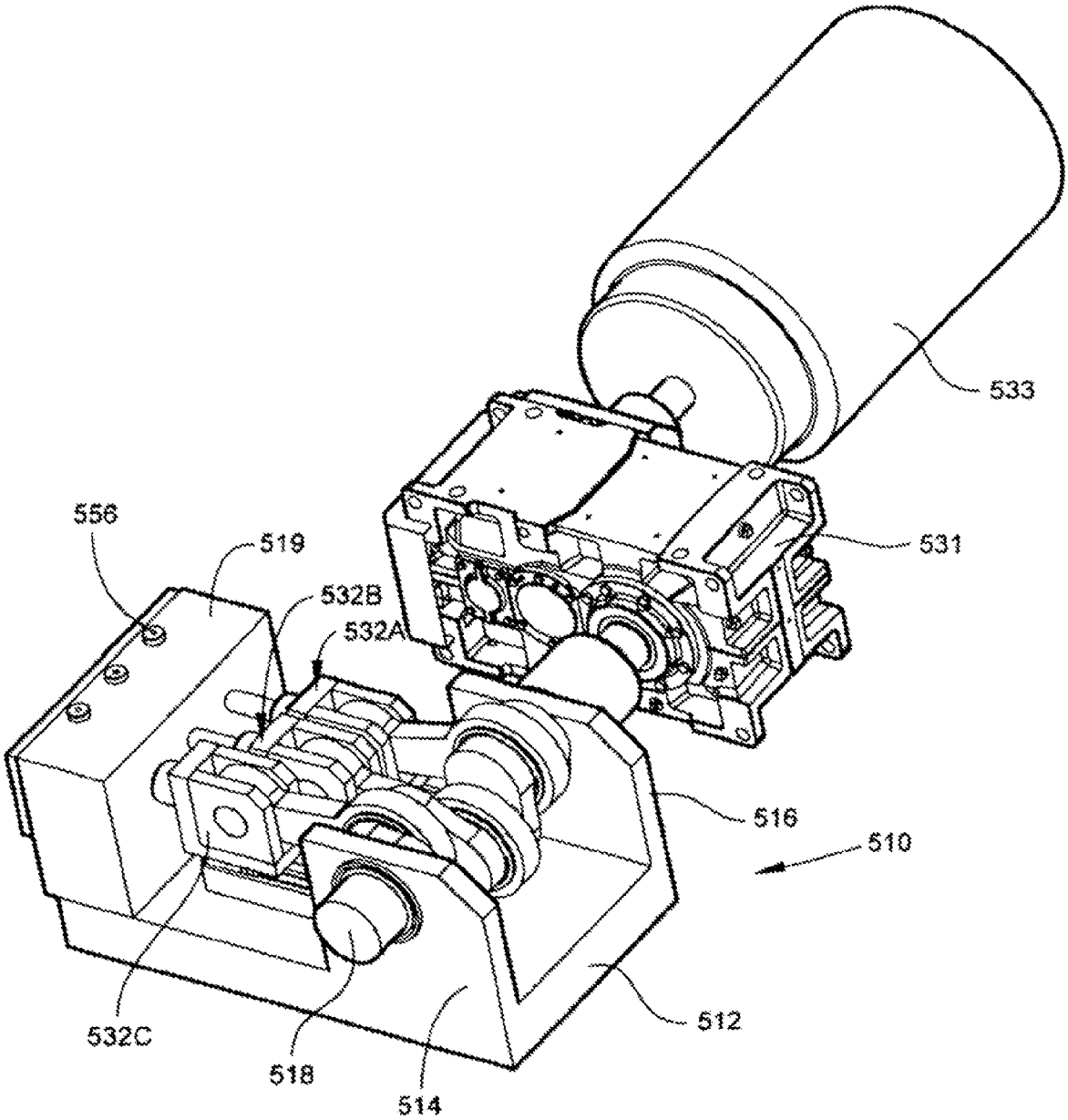
FIG. 11 is a schematic perspective of a pump constructed according to an alternative embodiment of the present invention.

FIG. 11 illustrates an alternative pump 510. The pump 510 is substantially similar in operating principle to the pump 10 described above, however it has a different structural configuration. The pump 510 includes a structural frame 512, which is a generally flat, elongated member having a pair of spaced-apart bosses 514 and 516 extending from a first end thereof. A cylinder block 519 is mounted to the frame 512 at the opposite end. A crankshaft 518 is carried in bearings 520 and 522, for example rolling-element bearings, mounted in the bosses 514 and 516, respectively, so that it can freely rotate relative to the frame 512. The crankshaft 518 includes offset crankpins 524, 526, and 528. One end of the crankshaft 518 is adapted to be driven by an external power source and is referred to as a input shaft 530. A speed reducer 531 of a known type is coupled to the input shaft 530, and is be driven by an electric motor 533. Alternatively, any kind of power source could be used to turn the input shaft 530.

The pump 510 includes at least one pump subassembly referred to generally at 532. In the illustrated example there are first, second, and third equally-spaced pump subassemblies 532A, 532B, and 532C. A larger or smaller number of pump subassemblies 532 may be used to suit a particular application. For the purposes of explanation, only the first pump subassembly 532A will be described in detail, with the understanding that it is representative of the construction of the other pump subassemblies 532B and 532C. The pump subassembly 532A includes a pivot block 534 which is mounted to the frame 512 by a linear bearing 536 of known type which allows the pivot block 534 to freely slide between the crankshaft 518 and the cylinder block 519, while preventing misalignment or lateral motion thereof. A connecting rod 538 has a first end 540 pivotally mounted on a wrist pin 542 carried in the pivot block 534, and a second end 544 pivotally mounted on one of the crankpins 528. Either or both of the first and second ends 540 and 544 may be mounted in bearings such as the illustrated rolling-element bearings 546 and 548, respectively. A cylindrical piston rod 550 extends radially outwardly from the pivot block 534 and into a bore 552 formed in the cylinder block 519.

Figure 12:
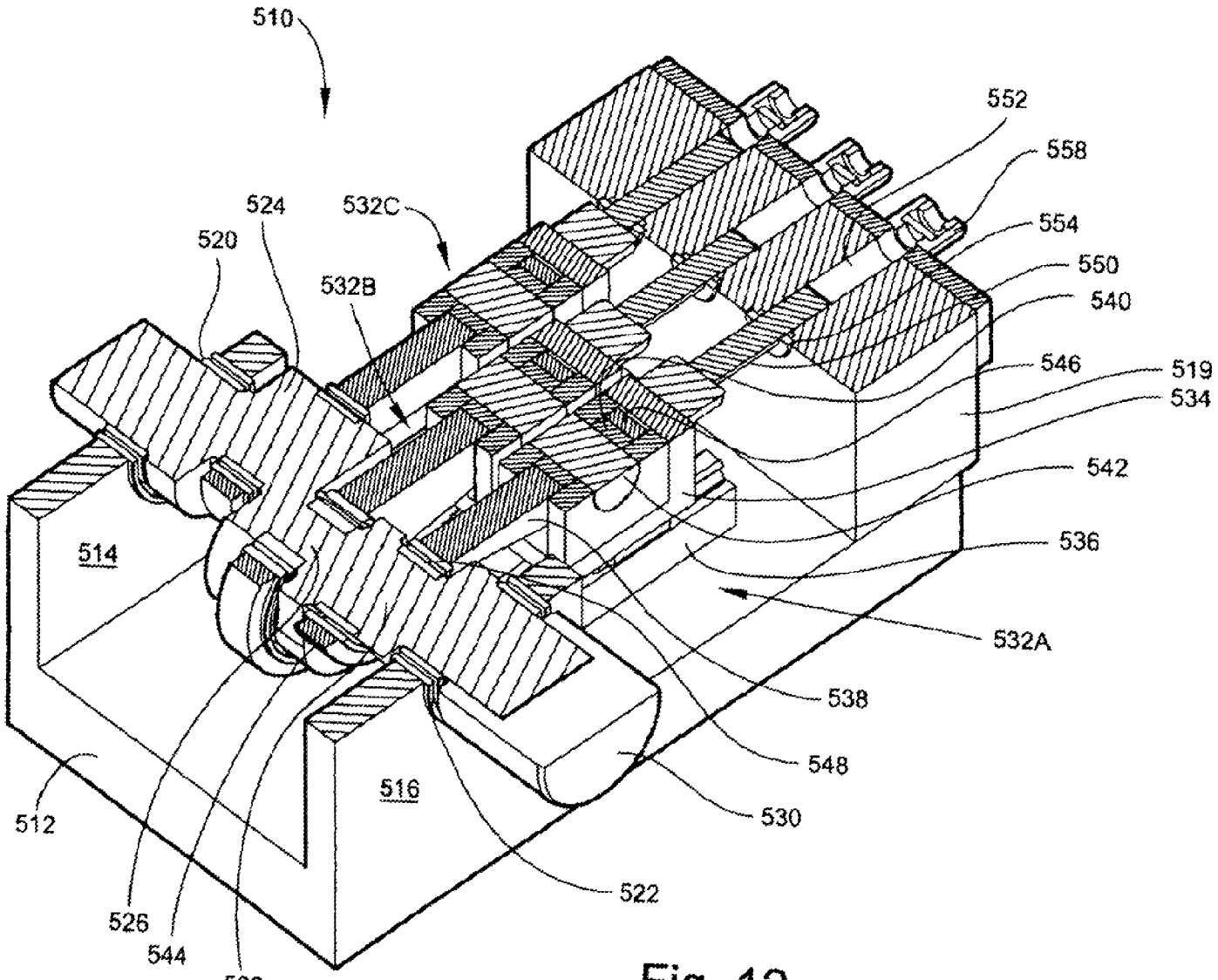
FIG. 12 is a perspective cut-away view of the pump of FIG. 11.

The bore 552 may be a simple cylindrical channel formed in the cylinder block 519. The bore 552 may also be defined by a built-up structure similar to the liner assembly 88 described above (not shown in FIG. 12). A high-pressure seal assembly 554, similar to the high-pressure seal 90 described above, is disposed in the bore 552 to prevent leakage between the piston rod 550 and the bore 552.

An inlet check valve 556 (see FIG. 11) is installed in fluid communication with the bore 552, and an outlet check valve 558 is installed in fluid communication with the end of the bore 552, The inlet check valve 556 is connected to suitable inlet piping (not shown), and the outlet check valve 558 is connected to suitable outlet piping (not shown).

In operation, the crankshaft 518 drives each of the pump subassemblies 532A, 532B, and 532C as it rotates. The arrangement of the pivot block 534 allows the connecting rod 538 to move in a swinging motion with the crankshaft 518, while allowing only rectilinear reciprocating motion of the piston rod 550. Any lateral force placed on the pump subassembly 532A as the crankshaft 518 cycles is relieved by pivoting motion about the wrist pin 542. This virtually eliminates any side load between the piston rod 550 and bore 552, which increases component life and avoids premature seal leakage. It also allows for a relatively long stroke while maintaining a robust supporting structure, in contrast to a prior art piston and rod arrangement which requires significant clearance for the rod motion. The crankpins 524, 526, and 528 may be suitably arranged based on the number of pump subassemblies 532 in this example 120.degree. out of phase, to provide even flow and minimize pressure pulses.

Figure 17:
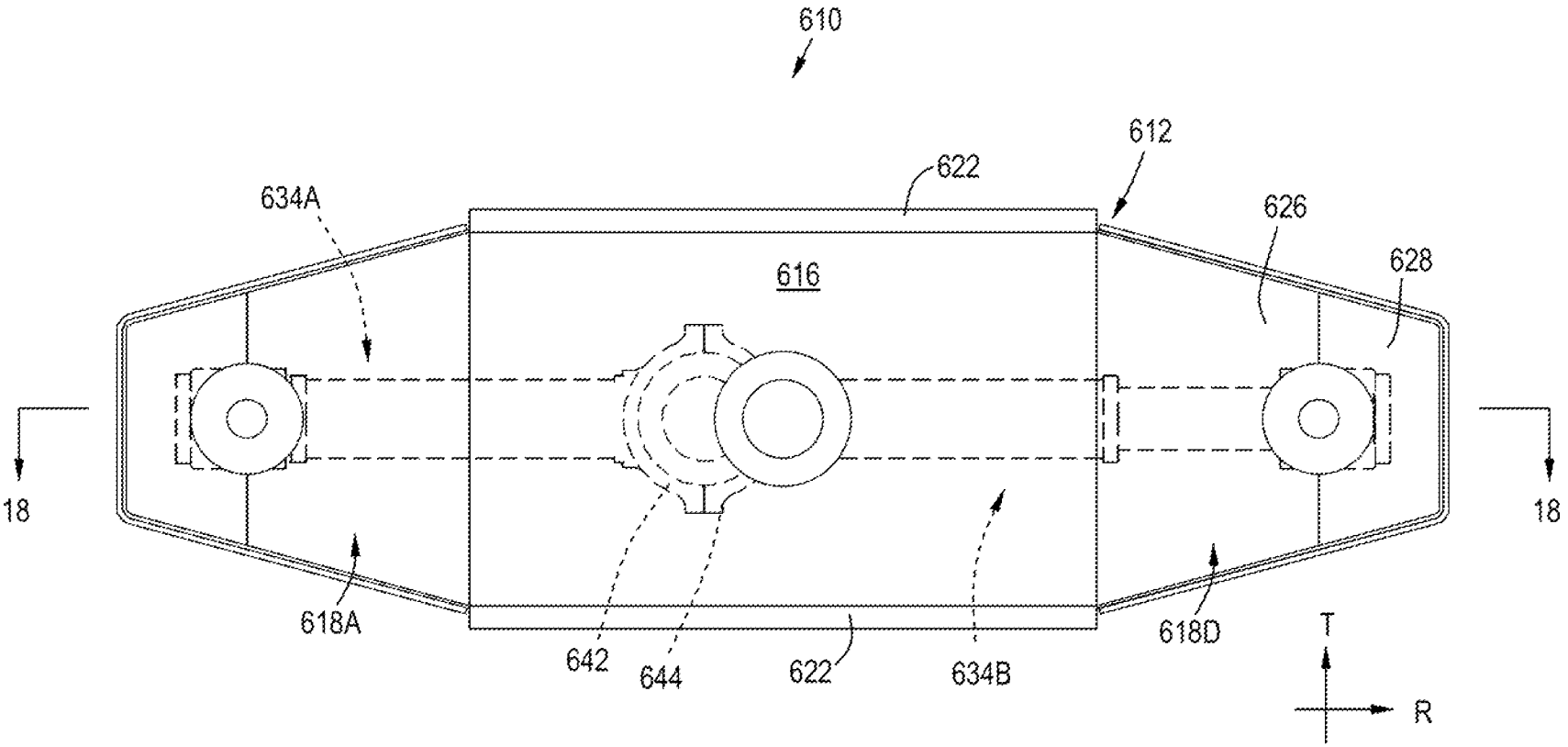
FIG. 17 is a side view of an alternative pump constructed according to an aspect of the invention.
Figure 18:
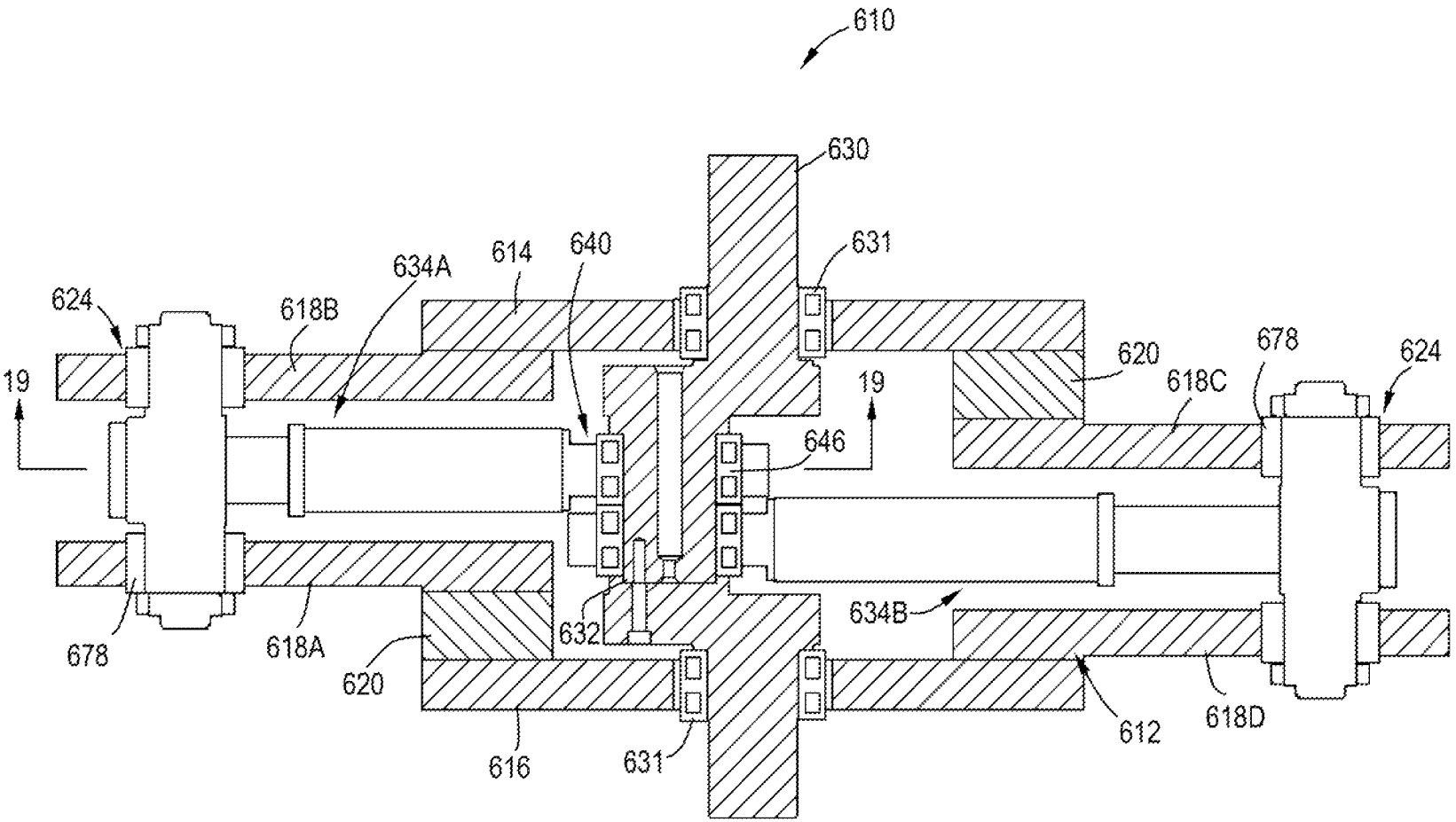
FIG. 18 is a cross-sectional view taken along lines 18-18 of FIG. 17.
Figure 19:
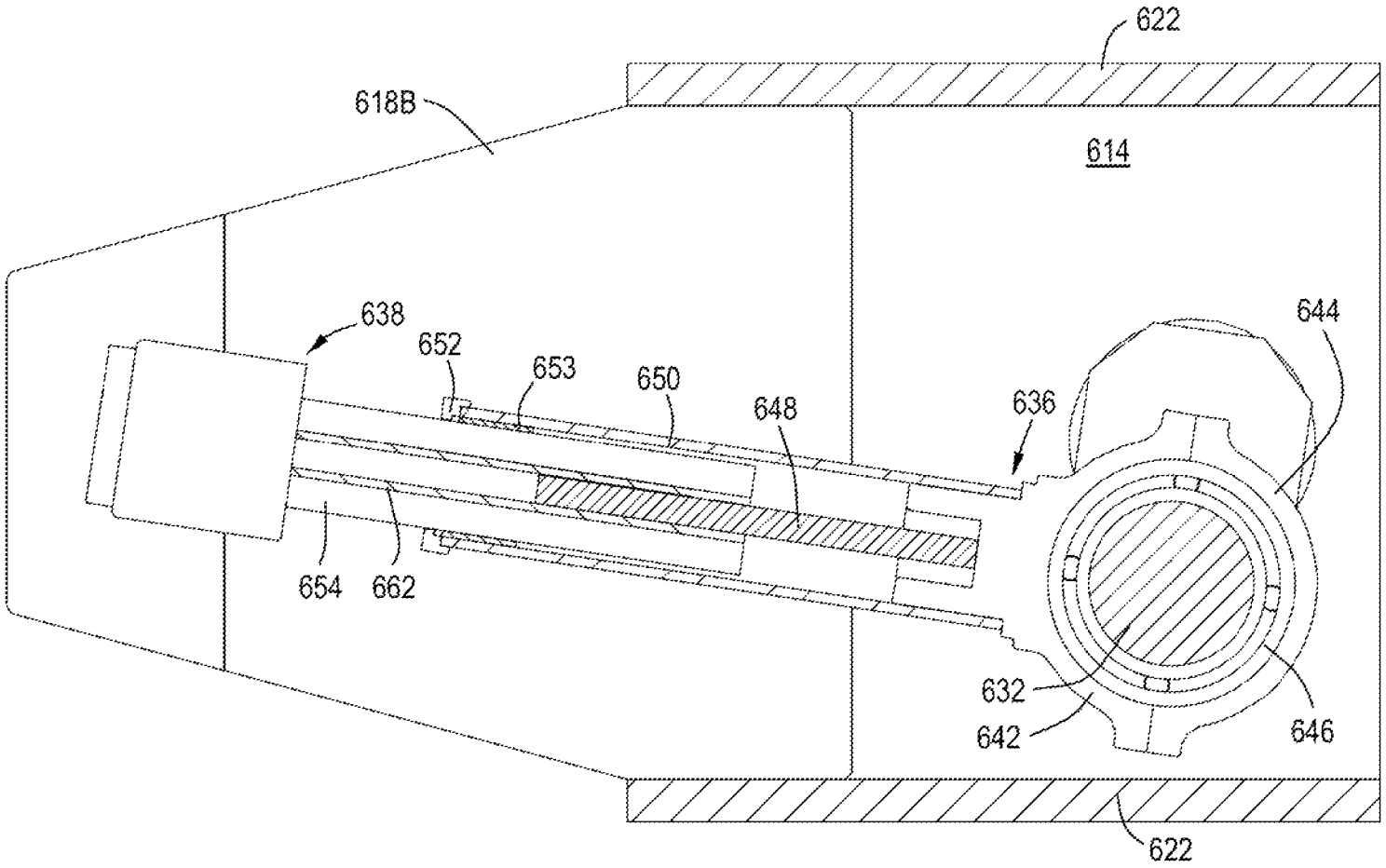
FIG. 19 is a cross-sectional view taken generally along lines 19-19 of FIG. 18, showing a crankshaft of the pump in a rotated position compared to FIG. 18.

FIGS. 17-19 illustrate another alternative ultrahigh-pressure pump 610. The pump 610 includes a frame 612 which is built up from spaced-apart side plates 614 and 616, arms generally referred to at 618, spacers 620, and cover plates 622. The side plates 614 and 616 and the cover plates 622 form a box-like structure with opposed open ends. As best seen in FIG. 18, a pair of the flat, plate-like arms 618A and 618B extend from one end of the box-like structure and another pair of arms 618C and 618D extend from the opposite end. The spacers 620 are positioned between the arm 618A and the side plate 616, and the arm 618C and the side plate 614, such that there is a lateral offset between the two opposed pairs of arms 618. While two pairs of arms 618 are shown for purposes of description, the pump could incorporate fewer or additional arms 618. Furthermore, it should be understood that instead of a built-up construction, the frame 612 could be assembled from one or more integral components such as castings. For example, a single casting could include structure analogous to a side plate 614 along with the associated spacer 620 and arms 618.

Each of the arms 618 carries an outer frame pivot 624 near its distal end. In particular, the outer pivot 624 comprises a saddle 626 (which is integral to an inner portion of the frame arm 618) and a cap 628 which cooperatively form a circular opening. A crankshaft 630 is carried in bearings 631, for example rolling-element bearings, mounted in the side plates 614 and 616, so that it can freely rotate relative to the frame 612. The crankshaft 630 may be an integral unit or it may have a multipart or built-up construction. It includes an offset journal 632. One or both ends of the crankshaft 630 are adapted to be driven by an external power source and thus may be considered to constitute an input shaft.

The pump 610 includes at least one pump subassembly referred to generally at 634. In the illustrated example there are first and second opposed pump subassemblies 634A and 634B. A larger or smaller number of pump subassemblies 634 may be used to suit a particular application. Each pump subassembly 634 comprises telescoping inner and outer members 636 and 638 (see FIG. 19). For the purposes of explanation, only the first pump subassembly 634A will be described in detail, with the understanding that it is representative of the construction of the other pump subassembly 634B. The inner member 636 has an inner pump pivot 640 disposed at its radially inner end. In particular, the inner pump pivot 640 comprises a saddle 642 and a cap 644 which cooperatively form a circular opening which receives the outer race of a rod bearing 646. In the illustrated example, the rod bearing 646 is a rolling-element bearing. It includes provisions which work in concert with other features of the pump 610 to ensure alignment of the pump subassembly 634A, as explained in more detail below. A cylindrical piston rod 648 extends radially outwardly from the inner member 636, and a concentric outer sleeve 650 surrounds the piston rod 648. The distal end of the outer sleeve 650 carries a rod holder 652 which is an annular member having a surface that rides against the outer surface of a cylinder 654. The rod holder 652 may be made of low-friction material such as a polymer and may have a cross-sectional shape that is configured to reduce sliding friction and/or improve angular compliance, e.g. a cylindrical or radiused surface. In addition to or as an alternative to the rod holder 652, one or more cylindrical sleeve bearings 653 may be disposed between the cylinder 654 and the outer sleeve 650. The sleeve bearings 653 may be made from polymer or other similar low-friction materials and may have a cross-sectional shape that is configured to reduce sliding friction and/or improve angular compliance, e.g. a cylindrical or radiused surface. The sleeve bearings 653, rod holder 652, or both are configured to maintain alignment of the piston rod 648 and the cylinder 654.

Figure 20:
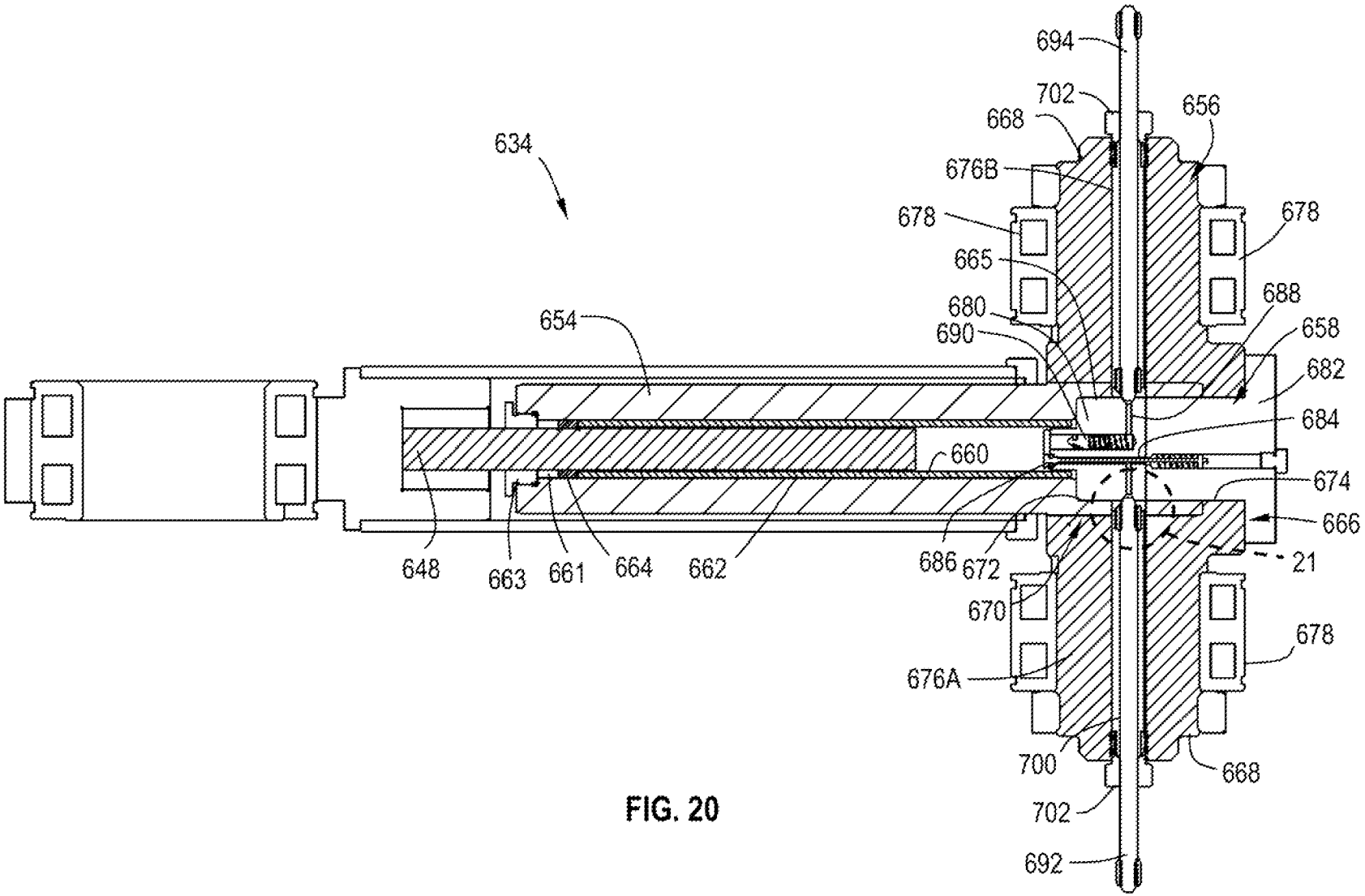
FIG. 20 is an enlarged view of a portion of FIG. 18, showing details of a pump subassembly.

As best seen in FIG. 20, the outer member 638 is generally "T" shaped. In the illustrated example, it is built-up from the radially-extending cylinder 654, a crossbar 656, and a valve cartridge 658. The cylinder 654 has an inner bore 660 formed therein. When assembled, the piston rod 648 fits into the inner bore 660 and the cylinder 654 fits into the outer sleeve 650.

The cylinder 654 receives an optional liner 662 and a high-pressure seal 664. The high pressure-seal 664 is held in place by a generally cylindrical backup ring 661 and a retaining nut 663. The backup ring 661 may be made from polymer or other similar low-friction materials and may have a cross-sectional shape that is configured to reduce sliding friction and/or improve angular compliance, e.g. a cylindrical or radiused surface. The high-pressure seal 664 may be any of the types described above with respect to pump 10. The pump 610 may also incorporate a secondary seal (not shown) as described above. The inner bore 660 is sized to receive the piston rod 648 with a small diametrical clearance, for example about 0.25 mm (0.010 in.). If a liner 662 is used, the inner bore 660 is defined by the liner 662. Also, if a liner 662 is used, there may be a controlled interference fit between the liner 662 and the cylinder 654, and they may be assembled together by known methods such as press fitting or by heating the cylinder 654 to expand it and then placing it over the liner 662. This results in the tangential stresses in the liner 662 being compressive at the inner bore 660. The stresses in the liner 662 will remain compressive until the working pressure in the inner bore 660 exceeds the preload stress. This arrangement resists cracking and failure of the liner 662 and is a more efficient use of material than if the cylinder 654 were a unitary structure. This compound construction of the liner 662 and the cylinder 654 may be extended to more than two cylindrical elements. For example, one or more intermediate liners (not shown) could be disposed between the liner 662 and the cylinder 654. A counterbore 665 is formed at the outer end of the cylinder 654 and receives the valve cartridge 658.

The crossbar 656 is an elongated member with a central portion 666 having two cylindrical trunnions 668 extending outward therefrom. A stepped central bore 670 with inner and outer portions 672 and 674 passes through the central portion 666 perpendicular to a rotational axis of the trunnions 668. Interior bores, generally identified at 676, pass through the rotational axis of the trunnions 668 and communicate with the central bore 670. For the purpose of description one of these bores is referred to as an "inlet crossbore" 676A, and the other one is referred to as an "outlet crossbore" 676B. The outer end of the cylinder 654 is received in the inner portion 672 of the central bore 670.

The trunnions 668 are received in the inner race of trunnion bearings 678, the outer races of which are received in the outer frame pivots 624 of the frame arms 618. In the illustrated example, the trunnion bearings 678 are rolling-element bearings. They may include provisions which work in concert with other features of the pump 610 to ensure alignment of the pump subassembly 634A, as explained in more detail below.

The valve cartridge 658 has a generally cylindrical body 680 and an enlarged head 682. The body 680 is received partially in the counterbore 664 of the cylinder 654 and partially in the outer portion 674 of the central bore 670 of the crossbar 656. The head 682 bears against an outer surface of the crossbar 656. The valve cartridge 658 includes an inlet passage 684 that communicates with the inner bore 660 of the cylinder 654 and with the inlet crossbore 676A. An inlet check valve 686 is installed in the inlet passage 684 and is configured so as to allow flow from the inlet passage to the inner bore 660, but to prevent flow in the opposite direction. In the illustrated example, the inlet check valve 686 is a spring-loaded valve with a conical valve member and seat.

The valve cartridge 658 includes an outlet passage 688 that communicates with the inner bore 660 of the cylinder 654 and with the outlet crossbore 676B. An outlet check valve 690 is installed in the outlet passage 688 and is configured so as to allow flow from the inner bore 660 to the outlet passage 688, but to prevent flow in the opposite direction. In the illustrated example, the outlet check valve 690 is a spring-loaded valve with a conical valve member and seat.

An inlet tube 692 is disposed in the inlet crossbore 676A. It is in fluid communication with the inlet passage 684 and extends through the distal end of the associated trunnion 668. An outlet tube 694 is disposed in the outlet crossbore 676B and communicates with the exterior of the inlet tube 692. It communicates with the outlet passage 688 and extends through the distal end of the associated trunnion 668.

Figure 21:
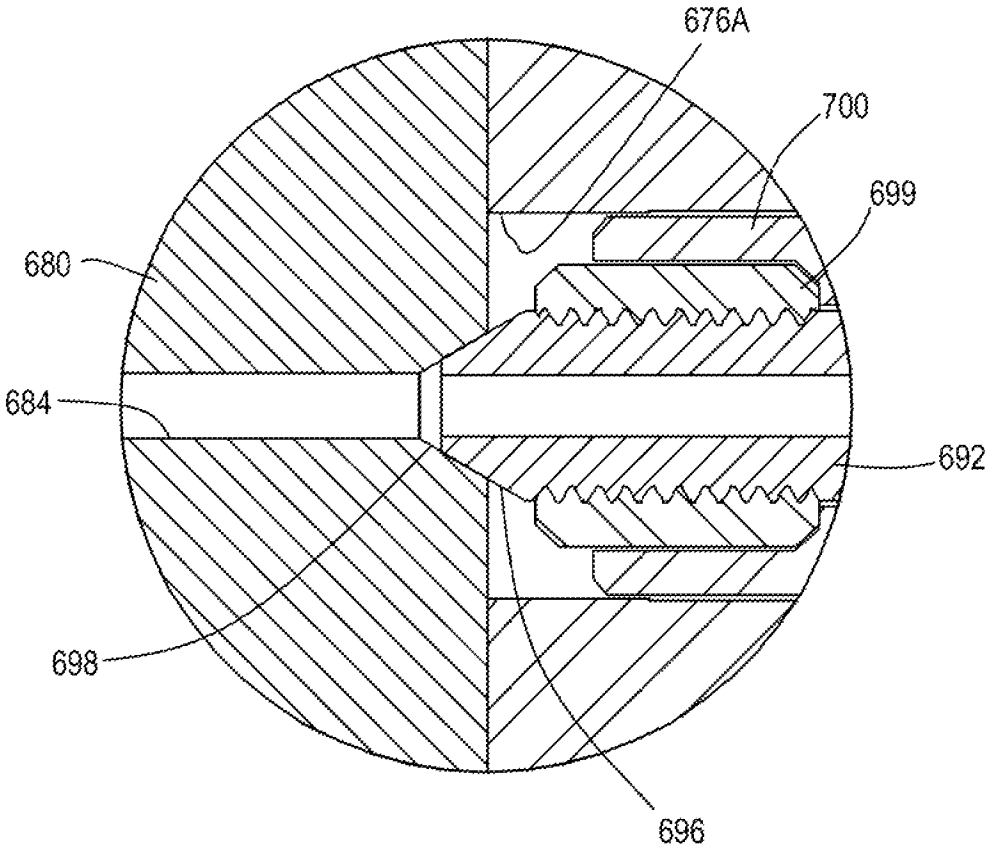
FIG. 21 is an enlarged view of a portion of FIG. 20.

As best seen in FIG. 21, the inner end of the inlet tube 692 is formed into a conical nose 696 which is received in a conical seat 698 of the inlet passage 684. Other shapes may be used so long as the inlet tube 692 and the seat 698 have complementary shapes effecting a fluid seal. For example, the two components could be flat-faced, complementary conical shapes, or complementary curved shapes (e.g. mating convex and concave shapes having spherical, elliptical, or other curvature). A collet 699 is threaded on to the inner end of the inlet tube 684 adjacent the nose 696. An elongated, generally cylindrical spacer 700 surrounds the inlet tube 692. A clamp nut 702 (see FIG. 20) is received in threads formed in the inlet crossbore 676A at the distal end of the trunnion 668. When the clamp nut 702 is tightened, force is transmitted from the clamp nut 702 through the spacer 700 and the collet 699 to the nose 696 of the inlet tube 692, compressing it against the seat 698 of the inlet passage 684. This configuration allows a leak-free seal without having to subject the inlet tube 692 to high compressive forces that might collapse it, and also allows assembly or disassembly access from the exterior of the pump 610. The construction of outlet tube 694 is substantially identical to that of the inlet tube 692, and it is installed in the same manner.

In operation, the inlet and outlet tubes 692 and 694 would be coupled to a fluid supply and to a system for utilizing the high-pressure fluid output, for example the pump 610 may be utilized in the waterjet cutting system 400 described above. In order to accommodate this usage, the pump 610 may be provided with a means for moving fluid between the inlet and outlet tubes 692 and 694, which oscillate with the pump subassembly 634 in operation, and stationary supply and discharge components. For example, a flexible discharge tube assembly similar to the discharge tube assembly 68 described above may be used, or a rotary union joint of a known type could be used. Alternatively, fluid flow need not be directed through the trunnions 668. For example, fluid may be routed through the valve cartridge 658 to and from the inner bore 660 in a direction generally coaxial to the cylinder 654.

From an ideal theoretical standpoint, the piston rod 648 and cylinder 654 should operate in a pure rectilinear reciprocating motion, in order to ensure the longest life and best sealing. While absolutely perfect alignment is not attainable in practice, the pump 610 incorporates provisions to ensure the best possible practical parallelism of the piston rod 648 and cylinder 654. To this end, the rod holder 652 and/or sleeve bearings 653 constitute a restraining element at the one end, and the high-pressure seal 664 and/or backup ring 663 at the other end constitute a restraining element at the other end. Both of these restraining elements are capable of resisting radial deflection which would be caused by lateral translation of the piston rod 648 relative to the cylinder 654. Cooperatively they define a two-point restraint of the piston rod 648 relative to the cylinder 654. As they are spaced apart from each other along the axis of the cylinder 654, they collectively resist bending moments that would tend to make the piston rod 648 not parallel to the cylinder 654. Such loads are generically referred to herein as "misalignment loads".

In conjunction with the two-point restraint, the pump 610 is configured such that misalignment loads applied to the piston rod 648 and cylinder 654 are minimized. This is partly implemented by the swinging motion of the cylinder 648. As described above with respect to the pump 110, any lateral force placed on the pump subassembly 634 as the crankshaft cycles is relieved by pivoting motion of the pump subassembly 634. This virtually eliminates any side load between the piston rod 648 and the inner bore 660 in the plane shown in FIG. 17, which increases component life and avoids premature seal leakage. It also allows for a relatively long stroke while maintaining a robust supporting structure, in contrast to a prior art piston and rod arrangement which requires significant clearance for the rod motion.

Some compliance is also permitted in the plane shown in FIG. 18. For example, the inner pivots 640 may be mounted to the rod bearings 646 so that some longitudinal (i.e. fore-and-aft) motion is allowed. For example, the rod bearings 646 shown permit about 0.13 mm (0.005 in.) displacement in a direction parallel to the crankpin rotational axis. Alternatively, the rod bearings 646 may be of a type which permits some angular displacement to achieve the same purpose. As an alternative to or in addition to the compliance at the inner pivots 640, the same type and degree of lateral and/or angular compliance could be implemented at the outer pivots 624 and trunnion bearings 678.

Under typical operating loads, the paired frame arms 618 may be expected to undergo elastic deformation, relative to a static position, in radial and tangential directions relative to the crankshaft 630, i.e. in the directions shown at "R" and "T" in FIG. 17. The arms 618 are mounted in a laterally offset position relative to the side plates 614 and 616. More specifically, with reference to FIG. 18, it can be seen that arm 618B is coupled directly to the side plate 614, while the opposite arm 618A is coupled to the other side plate 616 through the spacer 620. This configuration makes the arm 618A effectively less stiff and causes it to deflect more in the radial and tangential directions during pump operation, even if the arms 618A and 618B were of identical construction. Accordingly, in order to help maintain angular alignment of the cylinder 654 and the piston rod 648, the frame 612 may be configured to permit uniform radial and tangential deflection of each of the pairs of arms (i.e. arms 618A and 618B, and arms 618C and 618D). To effectuate equal deflection, the stiffness of the arm 618B (when considered as an individual "piece part") is made lower relative to that of the arm 618A. This could be done, for example, by reducing its overall thickness, tailoring its profile shape in section or plan view, incorporating grooves or holes therein, changing its mounting to the side plate 614, and the like. Preferably, the arms 618A and 618B are configured to have substantially the same radial and tangential deflection at each point through the stroke of the pump subassembly 634. In other words, they have equal effective stiffness in the radial and tangential directions. This feature further enhances cylinder bore-to-piston parallelism during pump operation.

Figure 22:
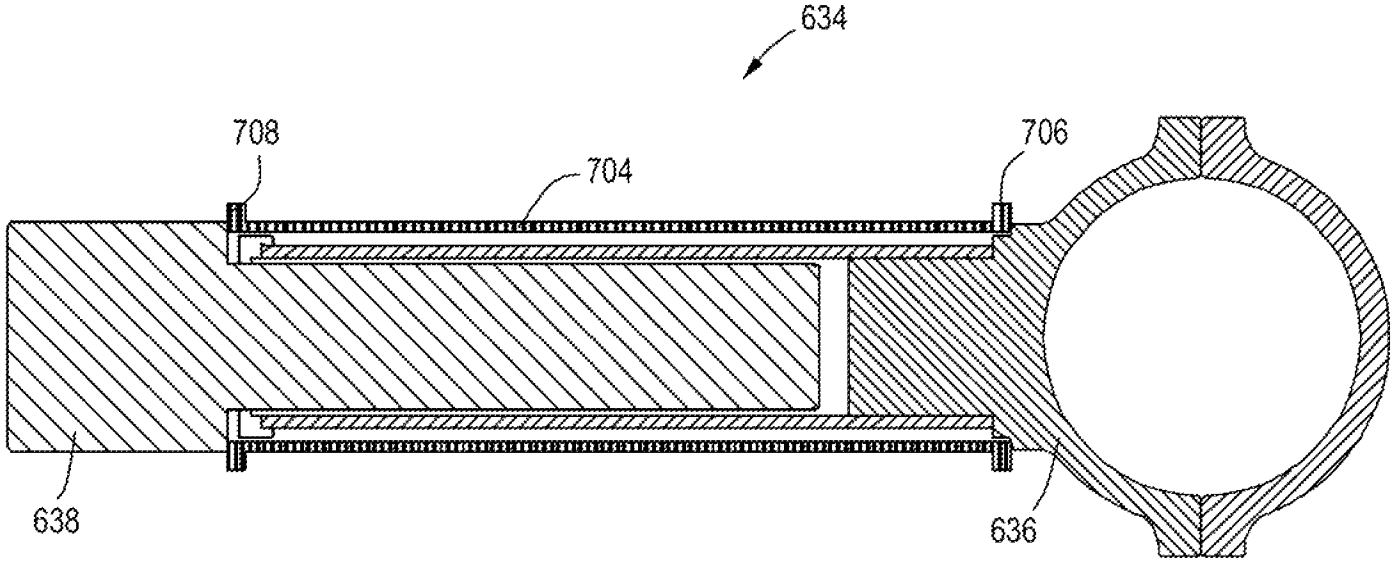
FIG. 22 is a cross-section view of a pump subassembly having a dust sleeve installed thereon.

FIG. 22 is a cross-sectional view of a pump subassembly 634 incorporating a flexible dust sleeve 704. The dust sleeve 704 is generally cylindrical and has a first end ring 706 which fits around the inner end of the inner member 636 and a second end ring 708 which fits around the outer end of the outer member 638. The dust sleeve 704 may be made from a material such as natural or synthetic polymers and is capable of stretching to accommodate the motion of the pump subassembly 634. The dust sleeve 704 is useful for excluding contaminants from the reciprocating components.

Figure 24:
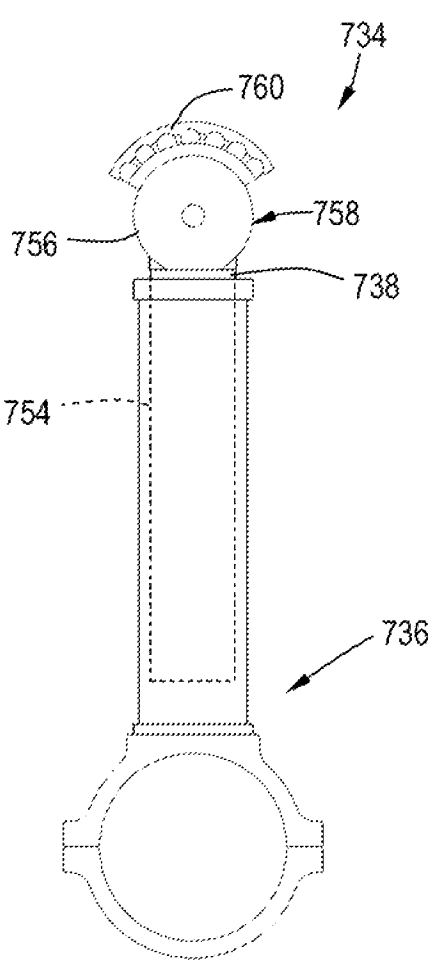
FIG. 24 is a front view of the pump subassembly shown in FIG. 23.
Figure 23:
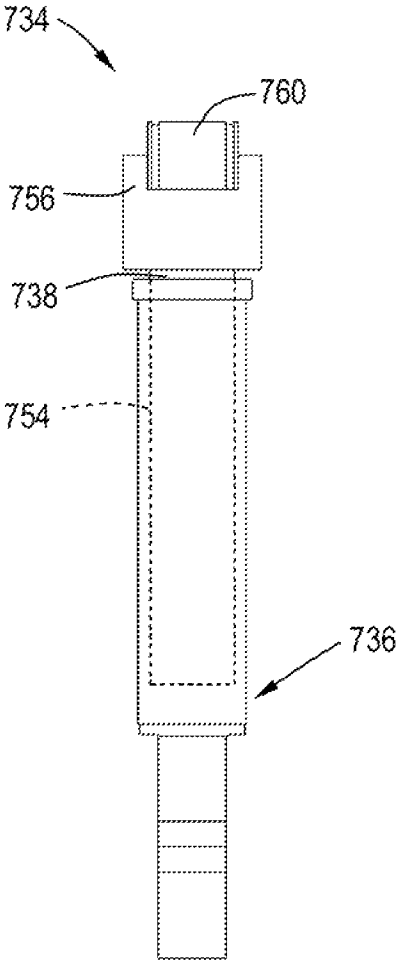
FIG. 23 is a side view of an alternative pump subassembly.

The outer pivot 624 of the pump subassembly 634 need not have a "T"-shaped configuration. For example, FIGS. 23 and 24 illustrate an alternative pump subassembly 734 which may be substituted in the pump 610 described above. The pump subassembly 734 includes an inner member 736 which is substantially identical in construction to the inner member 636 described above. It also includes a generally "T"-shaped outer member 738 comprising a cylinder 754 and crossbar 756. The crossbar 756 has a cylindrical outer surface 758. The outer surface 758 of the crossbar 756 is received in the inner race of a partial shell bearing 760 of a known type. In this example it is a rolling-element bearing, and it may include lateral or angular compliance provisions as described above. The outer race of the bearing 760 is in turn mounted to the frame (not shown) of the pump. The internal construction of the outer member 738, including internal fluid passages, valves, and connections to inlet and outlet tubes, are not shown but may be substantially the same as the outer member 638 described above.

Figure 25:
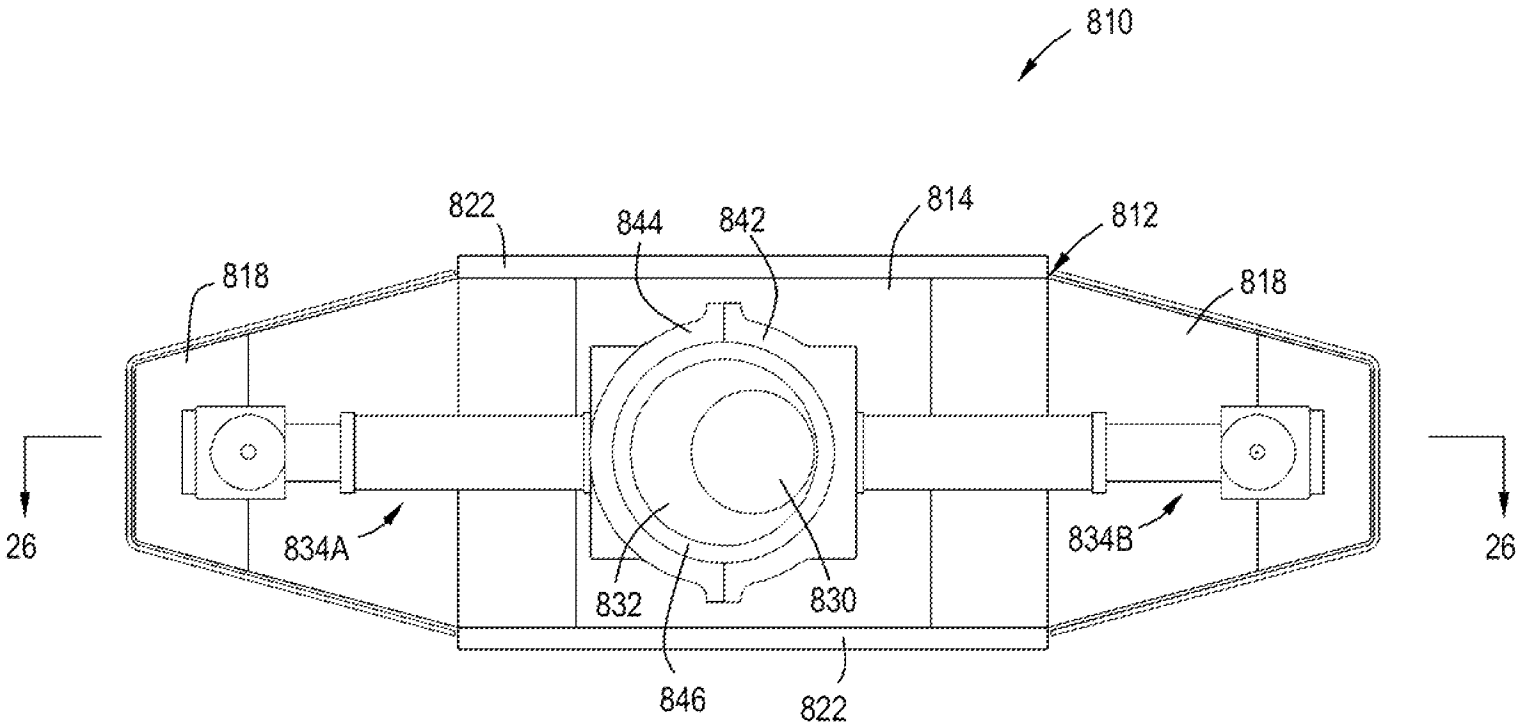
FIG. 25 is a side view of another alternative pump constructed according to an aspect of the invention, with a side plate removed to show the internal components thereof.
Figure 26:
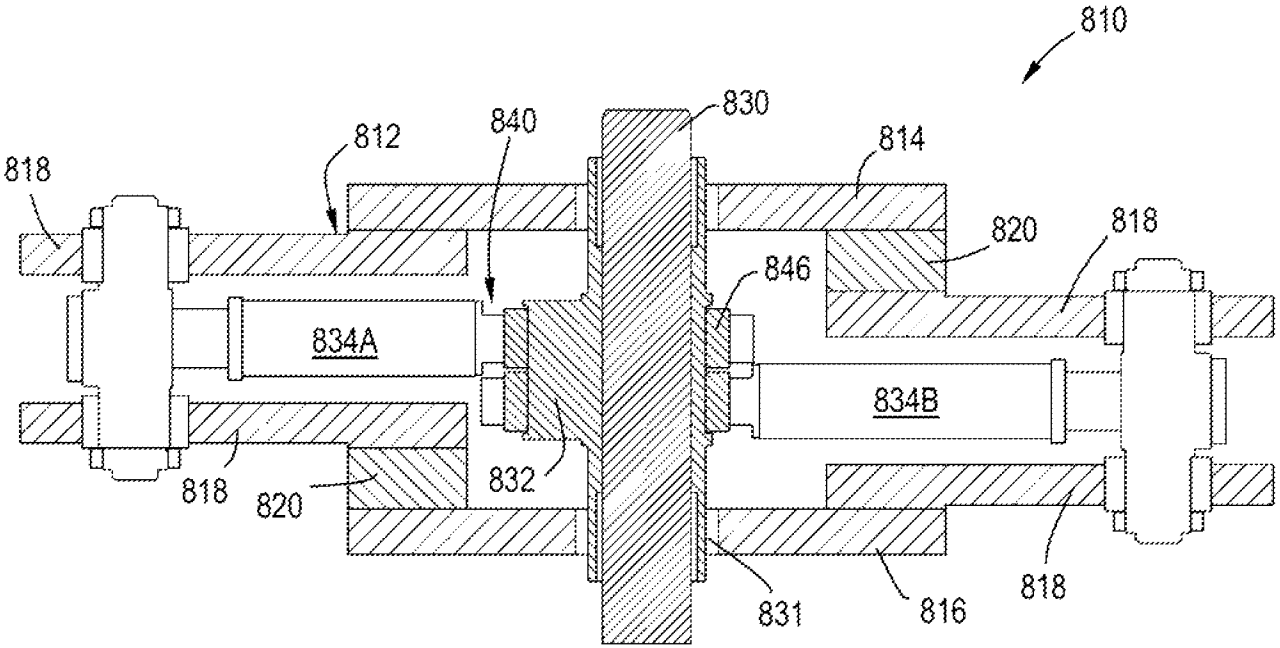
FIG. 26 is a cross-sectional view taken along lines 26-26 of FIG. 25.

FIGS. 25 and 26 illustrate another alternative ultrahigh-pressure pump 810 constructed according to another aspect of the present invention. This configuration improves stiffness and reduces bending loads in the pump's crankshaft. The general construction of the pump 810 is similar to that of pump 610 and includes a frame 812 with side plates 814 and 816, arms 818, spacers 820, and cover plates 822. The pump 810 also includes at least one pump subassembly referred to generally at 834. The pump subassembly 834 is identical in construction to the pump subassembly 834 described above except for its connection to the driving element of the pump 810. In the illustrated example there are first and second opposed pump subassemblies 834A and 834B. A larger or smaller number of pump subassemblies 834 may be used to suit a particular application.

A crankshaft 830 is carried in bearings 831, for example rolling-element bearings, mounted in the side plates 814 and 816, so that it can freely rotate relative to the frame 812. One or both ends of the crankshaft 830 are adapted to be driven by an external power source and thus may be considered to constitute an input shaft. The central portion of the crankshaft 830 between the side plates 814 and 816 incorporates an eccentric journal 832. The journal 832 is received in the inner race of a rod bearing 846. In the illustrated example the rod bearing 846 is a rolling-element bearing.

The inner member 836 of each pump subassembly 834 has an inner pivot 840 disposed at its radially inner end. In particular, the inner pivot 840 comprises a saddle 842 and a cap 844 which cooperatively form a circular opening which receives the outer race of the rod bearing 846. In this pivot configuration, as many pump subassemblies 834 as desired may be mounted side-by-side on the eccentric journal, whose length may be increased as necessary to accommodate the inner pivots 840.

The foregoing has described a ultrahigh pressure pump. While specific embodiments of the present invention have been described, it will be apparent to those skilled in the art that various modifications thereto can be made without departing from the spirit and scope of the invention.

What is claimed is:

1. An ultrahigh pressure pump, comprising:

a frame including a partial shell bearing;

a crankshaft rotatably mounted in the frame, the crankshaft having a journal comprising a surface offset from a rotational axis of the crankshaft;

at least one telescoping pump subassembly having inner and outer ends, wherein the outer end is carried by the partial shell bearing so as to allow pivotal swinging movement of the at least one pump subassembly about the partial shell bearing, and the inner end is pivotally attached to the journal, such that the at least one pump subassembly can reciprocate substantially without side loads thereupon, the at least one pump subassembly including:

an outer member having inner and outer ends, the outer end received in the partial shell bearing and the inner end including a cylinder having an inner bore formed therein and an elongated crossbar oriented substantially perpendicular to the cylinder, wherein an outer surface of the crossbar is received in the partial shell bearing and;

an inner member having an inner pump pivot disposed at an inner end thereof, an outwardly extending piston rod, and a coaxial outer sleeve surrounding the piston rod in spaced-apart relationship thereto, wherein the piston rod is received in the inner bore and the cylinder is received in the outer sleeve;

a first restraining element disposed at a first position along an axis of the at least one pump subassembly, the first restraining element configured to oppose lateral misalignment forces between the piston rod and the cylinder; and a second restraining element disposed at a second position along the an axis of the at least one pump subassembly spaced away from the first position, the second restraining element configured to oppose lateral misalignment forces between the piston rod and the cylinder.

2. The pump of claim 1 wherein:

the first restraining element is a generally cylindrical sleeve bearing disposed between the outer sleeve and an outer surface of the cylinder; and the second restraining element is a high-pressure seal disposed at the inner end of the cylinder which engages the piston rod.

3. The pump of claim 1 wherein:

the first restraining element is an annular rod holder disposed at a distal end of the outer sleeve which engages an outer surface of the cylinder; and the second restraining element is a high-pressure seal disposed at the inner end of the cylinder which engages the piston rod.

4. The pump of claim 1 wherein the outer member includes:

the cylinder;

the elongated crossbar oriented substantially perpendicular to the cylinder and having a central bore which receives the outer end of the cylinder; and a valve cartridge received in the central bore opposite the cylinder, the valve cartridge including:

an inlet passage having a first end communicating with the inner bore of the cylinder, and an inlet check valve disposed in the inlet passage; and an outlet passage having a first end communicating with the inner bore of the cylinder, and an outlet check valve disposed in the outlet passage.

5. The pump of claim 4 wherein at least one of the inlet and outlet passages includes a second end with a seat, the pump further including a tube assembly comprising:

a tube having an inner end with a nose with a complementary sealing shape bearing against the seat of the passage, and an outer end communicating with an exterior of the crossbar;

a collet attached to the tube adjacent the nose;

a tubular spacer surrounding the tube, the spacer having an inner end bearing against the collet; and a clamp nut engaging the outer member and bearing against an outer end of the tube.

6. The pump of claim 5 wherein the seat and the nose are both conical shapes.

7. The pump of claim 5 wherein the crossbar includes:

an inlet crossbore communicating with the exterior of the crossbar and the central bore; and an outlet crossbore communicating with the exterior of the crossbar and the central passage;

wherein a tube assembly is disposed in each of the inlet crossbore and the outlet crossbore.

8. The pump of claim 4 wherein the frame includes:

spaced-apart side plates disposed on opposite sides of the crankshaft journal;

a pair of spaced-apart arms extending from the side plates in a laterally offset position relative to the side plates, the arms positioned on opposite sides of the pump subassembly; and trunnion bearings carried in the arms which receive the crossbar;

wherein the arms are configured so as to have equal effective stiffness in radial and tangential directions relative to the crankshaft.

9. The pump of claim 1 wherein the cylinder includes a cylindrical inner liner which defines the inner bore, wherein the cylinder is assembled to the liner with a preselected interference fit such that a compressive preload is present in the liner.

10. The pump of claim 1 further comprising a flexible dust sleeve surrounding the cylinder and the outer sleeve.

11. The pump of claim 1 wherein the pump subassembly is connected to the frame such that at least one end of the pump subassembly can move laterally relative to a longitudinal axis of the pump subassembly, so as to maintain the piston rod substantially parallel to the inner bore.

12. The pump of claim 1 wherein the pump subassembly is connected to the frame such that at least one end of the pump subassembly can pivot relative to a longitudinal axis of the pump subassembly, so as to maintain the piston rod substantially parallel to the inner bore.

13. An ultrahigh pressure pump, comprising:

a frame including an outer frame pivot;

a crankshaft rotatably mounted in the frame, the crankshaft having a journal comprising a surface offset from a rotational axis of the crankshaft wherein the journal is an eccentric shape;

at least one telescoping pump subassembly having inner and outer ends, wherein the outer end is carried by the outer frame pivot so as to allow pivotal swinging movement of the at least one pump subassembly about the outer frame pivot, and the inner end is pivotally attached to the journal, such that the at least one pump subassembly can reciprocate substantially without side loads thereupon, the at least one pump subassembly including:

an outer member having inner and outer ends, the outer end received in the outer frame pivot and the inner end including a cylinder having an inner bore formed therein and;

an inner member having an inner pump pivot disposed at an inner end thereof, an outwardly extending piston rod, and a coaxial outer sleeve surrounding the piston rod in spaced-apart relationship thereto, wherein the piston rod is received in the inner bore and the cylinder is received in the outer sleeve;

a first restraining element disposed at a first position along the axis of the at least one pump subassembly, the first restraining element configured to oppose lateral misalignment forces between the piston rod and the cylinder; and a second restraining element disposed at a second position along the axis of the at least one pump subassembly spaced away from the first position, the second restraining element configured to oppose lateral misalignment forces between the piston rod and the cylinder.

14. A telescoping pump subassembly comprising:

a cylinder having an inner bore formed therein, with a piston rod received in the inner bore;

a high pressure seal carried at an end of the cylinder for preventing fluid leakage between the piston rod and the inner bore, the high-pressure seal including a metallic inner wall having a first diameter larger than an outside diameter of the piston rod, the inner wall comprising:

a circumferential first sealing band having a second diameter smaller than the outside diameter of the piston rod, so as to create a preselected interference between the first sealing band and the piston rod;

an axially-facing first annular surface joined to an upper end of the first sealing band;

an angled, circumferential first tapered surface joined to a lower end of the first sealing band, so as to define an annular first relief zone between the piston rod and the first tapered surface;

an axially-facing second annular surface axially displaced from the first annular surface in a direction extending away from the lower end of the first sealing band;

an annular groove formed in the second annular surface; and a resilient nonmetallic seal ring disposed in the annular groove.

15. An ultrahigh pressure pump, comprising:

a frame including an outer frame pivot;

a crankshaft rotatably mounted in the frame, the crankshaft having a journal comprising a surface offset from a rotational axis of the crankshaft wherein the journal is an eccentric shape;

at least one telescoping pump subassembly having inner and outer ends, wherein the outer end is carried by the outer frame pivot so as to allow pivotal swinging movement of the at least one pump subassembly about the outer frame pivot, and the inner end is pivotally attached to the journal, the at least one pump subassembly including:

an outer member including:

a cylinder having an inner bore;

an elongated crossbar oriented substantially perpendicular to the cylinder and having a central bore which receives an outer end of the cylinder, the crossbar defining an outer pump pivot which is coupled to the outer frame pivot; and a valve cartridge received in the central bore opposite the cylinder, the valve cartridge including:

an inlet passage having a first end communicating with the inner bore of the cylinder, and an inlet check valve disposed in the inlet passage; and an outlet passage having a first end communicating with the inner bore of the cylinder, and an outlet check valve disposed in the outlet passage; and an inner member having an inner pump pivot disposed at an inner end thereof which is coupled to the journal, an outwardly extending piston rod, and a coaxial outer sleeve surrounding the piston rod in spaced-apart relationship thereto, wherein the piston rod is received in the inner bore and the cylinder is received in the outer sleeve.

16. The pump of claim 15 wherein at least one of the inlet and outlet passages includes a second end with a seat, the pump further including a tube assembly comprising:

a tube having an inner end with a nose having complementary sealing shape bearing against the seat of the passage, and an outer end communicating with an exterior of the crossbar;

a collet attached to the tube adjacent the nose;

a tubular spacer surrounding the tube, the spacer having an inner end bearing against the collet; and a clamp nut engaging the outer member and bearing against an outer end of the tube.

17. The pump of claim 16 wherein the seat and the nose are both conical shapes.

18. The pump of claim 16 wherein the crossbar includes:

an inlet crossbore communicating with the exterior of the crossbar and the central bore; and an outlet crossbore communicating with the exterior of the crossbar and the central passage;

wherein a tube assembly is disposed in each of the inlet crossbore and the outlet crossbore.

19. The pump of claim 15 wherein the crossbar includes:

a central portion which includes the central bore; and cylindrical trunnions extending from opposite ends of the central portion.

20. The pump of claim 19 wherein each of the trunnions is received in a trunnion bearing which is carried by the frame.

21. An ultrahigh pressure pump, comprising:

a frame including a partial shell bearing;

a crankshaft rotatably mounted in the frame, the crankshaft having a journal comprising a surface offset from a rotational axis of the crankshaft wherein the journal is an eccentric shape;

at least one telescoping pump subassembly having inner and outer ends, wherein the outer end is carried by the partial shell bearing so as to allow pivotal swinging movement of the at least one pump subassembly about the outer frame pivot, and the inner end is pivotally attached to the journal, the at least one pump subassembly including:

an outer member including:

a cylinder having an inner bore;

an elongated crossbar oriented substantially perpendicular to the cylinder and having a central bore which receives an outer end of the cylinder, the crossbar defining an outer pump pivot which is received in the partial shell bearing; and a valve cartridge received in the central bore opposite the cylinder, the valve cartridge including:

an inlet passage having a first end communicating with the inner bore of the cylinder, and an inlet check valve disposed in the inlet passage; and an outlet passage having a first end communicating with the inner bore of the cylinder, and an outlet check valve disposed in the outlet passage; and an inner member having an inner pump pivot disposed at an inner end thereof which is coupled to the journal, an outwardly extending piston rod, and a coaxial outer sleeve surrounding the piston rod in spaced-apart relationship thereto, wherein the piston rod is received in the inner bore and the cylinder is received in the outer sleeve.

22. The pump of claim 21 wherein at least one of the inlet and outlet passages includes a second end with a seat, the pump further including a tube assembly comprising:

a tube having an inner end with a nose having complementary sealing shape bearing against the seat of the passage, and an outer end communicating with an exterior of the crossbar;

a collet attached to the tube adjacent the nose;

a tubular spacer surrounding the tube, the spacer having an inner end bearing against the collet; and a clamp nut engaging the outer member and bearing against an outer end of the tube.

23. The pump of claim 22 wherein the seat and the nose are both conical shapes.

24. The pump of claim 22 wherein the crossbar includes:

an inlet crossbore communicating with the exterior of the crossbar and the central bore; and an outlet crossbore communicating with the exterior of the crossbar and the central passage;

wherein a tube assembly is disposed in each of the inlet crossbore and the outlet crossbore.

* * * * *